US009862467B2

(12) United States Patent
Norrie et al.

(10) Patent No.: US 9,862,467 B2
(45) Date of Patent: Jan. 9, 2018

(54) SECURING MECHANISM FOR WATER CRAFT FIN

(71) Applicant: FIN CONTROL SYSTEMS PTY LIMITED, Mona Vale, New South Wales (AU)

(72) Inventors: Scott Norrie, Mona Vale (AU); Michael Durante, Mona Vale (AU); Gregory Scott, Mona Vale (AU); Linden Evans, Mona Vale (AU)

(73) Assignee: Fin Control Systems Pty Limited, New South Whales (AU)

( * ) Notice: Subject to any disclaimer, the term of this patent is extended or adjusted under 35 U.S.C. 154(b) by 0 days.

(21) Appl. No.: 15/262,068

(22) Filed: Sep. 12, 2016

(65) Prior Publication Data

US 2016/0375968 A1 Dec. 29, 2016

Related U.S. Application Data

(63) Continuation-in-part of application No. PCT/AU2015/050092, filed on Mar. 9, 2015, and a continuation-in-part of application No. 14/411,667, filed as application No. PCT/AU2013/000738 on Jul. 5, 2013, now Pat. No. 9,688,365.

(30) Foreign Application Priority Data

Jul. 9, 2012 (AU) ..... 2012902939
Mar. 11, 2014 (AU) ..... 2014900816

(51) Int. Cl.
*B63B 35/79* (2006.01)

(52) U.S. Cl.
CPC ..... *B63B 35/793* (2013.01)

(58) Field of Classification Search
CPC ..... B63B 35/793; B63B 35/7926
USPC ..... 441/74, 79
See application file for complete search history.

(56) References Cited

U.S. PATENT DOCUMENTS 3,516,099 A 6/1970 Morey et al.
3,564,632 A 2/1971 Bahne, Jr.
3,579,681 A 5/1971 Pope, III et al.
3,585,663 A 6/1971 Johnson
(Continued)

FOREIGN PATENT DOCUMENTS

AU 8447182 7/1981
AU 8415382 5/1982
(Continued)

OTHER PUBLICATIONS

Boardsport Source, 2011.
(Continued)

*Primary Examiner* — Anthony D Wiest
(74) *Attorney, Agent, or Firm* — Whitham, Curtis & Cook, P.C.

(57) ABSTRACT

A securing arrangement for securing a water craft fin to a water craft having a fin plug, the fin plug having a first open cavity configured to receive a base portion (4018) of the water craft fin. The securing arrangement includes a resilient biasing rod (4030) and a protruding member (4035) cooperating with the biasing rod (4030). The protruding member (4035) is adapted to actuate when the base portion (4018) of the fin is inserted into the first open cavity of the fin plug so that the biasing rod (4030) and the protruding member (4035) inhibit removal of the fin from the first open cavity.

25 Claims, 61 Drawing Sheets

(56) References Cited

U.S. PATENT DOCUMENTS

| | | | |
|---|---|---|---|
| 3,659,300 | A | 5/1972 | Johnson |
| 3,879,782 | A | 4/1975 | Oliver |
| 3,890,661 | A | 6/1975 | Johnson |
| 3,965,514 | A | 6/1976 | Shafer et al. |
| 4,044,416 | A | 8/1977 | Brewer et al. |
| 4,325,154 | A | 4/1982 | Collum, Jr. |
| 4,320,546 | A | 5/1982 | Knox |
| 4,379,703 | A | 4/1983 | Mizell |
| 4,398,485 | A | 8/1983 | Diziere |
| 4,421,492 | A | 12/1983 | Leva |
| 4,493,655 | A | 1/1985 | Groff |
| 4,493,665 | A | 1/1985 | Liddle |
| 4,537,143 | A | 8/1985 | Gaide |
| 4,701,144 | A | 10/1987 | Dewitt, III |
| 4,710,144 | A | 12/1987 | Hunt |
| 4,733,496 | A | 3/1988 | Wallner |
| 4,789,368 | A | 12/1988 | D'Onofrio |
| 4,804,347 | A | 2/1989 | Ross |
| 4,846,745 | A | 7/1989 | Lobe |
| 4,850,917 | A | 7/1989 | Wilson et al. |
| 4,854,904 | A | 8/1989 | Wahl |
| 4,904,215 | A | 2/1990 | Sherwood |
| 4,964,826 | A | 10/1990 | Lobe |
| 5,030,151 | A | 7/1991 | Beacham |
| 5,032,096 | A | 7/1991 | Scott et al. |
| 5,112,091 | A | 5/1992 | Kluting |
| 5,133,681 | A | 7/1992 | Lobe |
| 5,148,761 | A | 9/1992 | Winner |
| 5,176,096 | A | 1/1993 | Molnar et al. |
| 5,176,553 | A | 1/1993 | Tuttle |
| 5,215,488 | A | 6/1993 | Bailey |
| 5,224,435 | A | 9/1993 | Billett |
| 5,242,322 | A | 9/1993 | Chellemi et al. |
| 5,273,472 | A | 12/1993 | Skedeleski et al. |
| 5,306,188 | A | 4/1994 | Skedeleski et al. |
| 5,328,397 | A | 7/1994 | Whitty |
| 5,356,324 | A | 10/1994 | Cunningham |
| 5,464,359 | A | 11/1995 | Whitty |
| 5,480,331 | A | 1/1996 | Lewis |
| 5,493,989 | A | 2/1996 | Anderson |
| 5,503,581 | A | 4/1996 | McCullough |
| 5,567,190 | A | 10/1996 | Oates |
| 5,597,337 | A | 1/1997 | Nedderman, Jr. |
| 5,649,846 | A | 7/1997 | Harper et al. |
| 5,672,081 | A | 9/1997 | Whitty |
| 5,830,025 | A | 11/1998 | Fleming |
| 5,934,962 | A | 8/1999 | Daum et al. |
| 5,934,963 | A | 8/1999 | Frizzell |
| 5,951,347 | A | 9/1999 | Hudson et al. |
| 5,975,974 | A | 11/1999 | McCausland |
| 5,997,376 | A | 12/1999 | Block et al. |
| 6,053,789 | A | 4/2000 | Miyashiro |
| 6,068,531 | A | 5/2000 | Patterson |
| 6,106,346 | A | 8/2000 | Bolen |
| 6,139,383 | A | 10/2000 | Jolly et al. |
| 6,213,004 | B1 | 4/2001 | Rodgers et al. |
| 6,217,402 | B1 | 4/2001 | Bolen |
| 6,244,921 | B1 | 6/2001 | Pope |
| 6,247,985 | B1 | 6/2001 | Block et al. |
| 6,322,413 | B1 | 11/2001 | Webber |
| 6,379,204 | B2 | 4/2002 | Bolen |
| 6,386,933 | B1 | 5/2002 | Rewald et al. |
| 6,439,940 | B1 | 8/2002 | Pouchkarev |
| 6,551,157 | B1 | 4/2003 | Bishop |
| 6,595,817 | B1 | 7/2003 | Chang |
| 6,695,662 | B2 | 2/2004 | Kelley |
| 6,739,925 | B2 | 5/2004 | Bums et al. |
| 6,746,292 | B2 | 6/2004 | Panzer |
| 6,752,674 | B2 | 6/2004 | Jolly |
| 6,764,364 | B1 | 7/2004 | Hickman et al. |
| 6,767,266 | B2 | 7/2004 | Bolen |
| 6,793,548 | B2 | 9/2004 | Jolly et al. |
| 6,821,173 | B2 | 11/2004 | McCausland et al. |
| 6,837,763 | B1 | 1/2005 | Masteller |
| D502,522 | S | 3/2005 | Sperafico |
| 6,896,570 | B1 | 5/2005 | O'Keefe et al. |
| 6,916,220 | B2 | 7/2005 | Davey et al. |
| 6,918,806 | B2 | 7/2005 | Skedeleski |
| 6,935,910 | B2 | 8/2005 | Laine |
| RE38,840 | E | 10/2005 | Patterson |
| 6,986,570 | B2 | 1/2006 | Jones et al. |
| 6,991,503 | B2 | 1/2006 | Garcia |
| 6,991,504 | B1 | 2/2006 | English et al. |
| 7,025,645 | B1 | 4/2006 | Hsieh |
| 7,029,352 | B1 | 4/2006 | Suzuki |
| 7,037,154 | B1 | 5/2006 | Suzuki |
| 7,108,571 | B2 | 9/2006 | Geraghty |
| 7,117,699 | B2 | 10/2006 | Bistline |
| 7,121,911 | B1 | 10/2006 | Hickman |
| 7,182,661 | B2 | 2/2007 | Sams et al. |
| 7,198,532 | B2 | 4/2007 | Field |
| 7,244,157 | B2 | 7/2007 | Simpson |
| 7,264,524 | B2 | 9/2007 | Batt |
| 7,285,031 | B2 | 10/2007 | Mair et al. |
| 7,311,576 | B2 | 12/2007 | Pope |
| 7,393,256 | B2 | 7/2008 | Clutton et al. |
| 7,497,752 | B2 | 3/2009 | Field |
| 7,524,225 | B1 | 4/2009 | Richenberg et al. |
| 7,654,168 | B2 | 2/2010 | O'Brien et al. |
| 7,896,718 | B2 | 3/2011 | Jones |
| 8,393,928 | B2 | 3/2013 | Kumano et al. |
| 2001/0006864 | A1 | 7/2001 | Bolen |
| 2002/0039866 | A1 | 4/2002 | Jolly et al. |
| 2002/0102890 | A1 | 8/2002 | Bolen |
| 2002/0155769 | A1 | 10/2002 | Herbert et al. |
| 2003/0040236 | A1 | 2/2003 | Burns et al. |
| 2003/0087564 | A1 | 5/2003 | Kelley |
| 2003/0092333 | A1 | 5/2003 | McCausland et al. |
| 2003/0092334 | A1 | 5/2003 | McCausland et al. |
| 2003/0124924 | A1 | 7/2003 | McCausland et al. |
| 2003/0159475 | A1 | 8/2003 | Tan |
| 2003/0220030 | A1 | 11/2003 | Jolly |
| 2003/0236039 | A1 | 12/2003 | Banys, Jr. |
| 2004/0035346 | A1 | 2/2004 | Davey et al. |
| 2004/0043681 | A1 | 3/2004 | Jolly et al. |
| 2004/0072483 | A1 | 4/2004 | Panzer |
| 2004/0092180 | A1 | 5/2004 | Turkington |
| 2004/0214486 | A1 | 10/2004 | McCausland et al. |
| 2004/0235374 | A1 | 11/2004 | Garcia |
| 2004/0242093 | A1 | 12/2004 | Geraghty |
| 2004/0248428 | A1 | 12/2004 | Larkin |
| 2004/0248482 | A1 | 12/2004 | Larkin |
| 2005/0059304 | A1 | 3/2005 | Laine |
| 2005/0064775 | A1 | 3/2005 | White |
| 2005/0075017 | A1 | 4/2005 | Bistline |
| 2005/0124238 | A1 | 6/2005 | Clutton et al. |
| 2005/0142961 | A1 | 6/2005 | Tan |
| 2005/0211423 | A1 | 9/2005 | Blake, Jr. |
| 2005/0260903 | A1 | 11/2005 | Batt |
| 2005/0272326 | A1 | 12/2005 | Hopper |
| 2005/0287222 | A1 | 12/2005 | Balester |
| 2005/0287888 | A1 | 12/2005 | Balester |
| 2006/0019559 | A1 | 1/2006 | Mair et al. |
| 2006/0019599 | A1 | 1/2006 | Kahlman et al. |
| 2006/0035543 | A1 | 1/2006 | English et al. |
| 2006/0166576 | A1 | 7/2006 | Pope |
| 2006/0178061 | A1 | 8/2006 | Caldwell |
| 2006/0189230 | A1 | 8/2006 | Sams et al. |
| 2007/0218788 | A1 | 9/2007 | Field |
| 2008/0191423 | A1 | 8/2008 | Cohen |
| 2008/0207070 | A1 | 8/2008 | Van Gelder |
| 2008/0220672 | A1 | 9/2008 | Koelling |
| 2008/0261470 | A1 | 10/2008 | Jones |
| 2008/0268730 | A1 | 10/2008 | Heesterman |
| 2009/0199375 | A1 | 8/2009 | Koelling et al. |
| 2009/0253319 | A1 | 10/2009 | Ferru |
| 2010/0120305 | A1 | 5/2010 | Posner et al. |
| 2010/0136860 | A1 | 6/2010 | Jolly |
| 2010/0159759 | A1 | 6/2010 | Graden |
| 2010/0173546 | A1 | 7/2010 | Yeh |
| 2010/0178820 | A1 | 7/2010 | Kumano |
| 2010/0233921 | A1 | 9/2010 | Kumano et al. |
| 2010/0273373 | A1 | 10/2010 | Field |
| 2010/0279563 | A1 | 11/2010 | Heard et al. |

(56) References Cited

U.S. PATENT DOCUMENTS

| | | | |
|---|---|---|---|
| 2010/0311294 | A1 | 12/2010 | Foulke |
| 2011/0028258 | A1 | 2/2011 | Kumano |
| 2011/0039463 | A1 | 2/2011 | Hort et al. |
| 2011/0039464 | A1 | 2/2011 | McTavish |
| 2011/0053443 | A1 | 3/2011 | McTavish |
| 2011/0061579 | A1 | 3/2011 | Van Gelder |
| 2011/0070787 | A1 | 3/2011 | Lausman |
| 2012/0071048 | A1 | 3/2012 | Foulke |

FOREIGN PATENT DOCUMENTS

| | | | |
|---|---|---|---|
| AU | 8599282 | | 7/1982 |
| AU | 8599982 | | 7/1982 |
| AU | 8118387 | A | 2/1987 |
| AU | 3408893 | B | 9/1993 |
| AU | 5937394 | B | 3/1995 |
| AU | 8150294 | A | 6/1995 |
| AU | 199521660 | A1 | 6/1995 |
| AU | 4079996 | B | 4/1996 |
| AU | 2166095 | B | 5/1996 |
| AU | 21660955 | B | 5/1996 |
| AU | 199739335 | B2 | 10/1996 |
| AU | 199884218 | B3 | 7/1999 |
| AU | 199889534 | B3 | 7/1999 |
| AU | 2006101078 | A5 | 1/2001 |
| AU | 200197113 | A1 | 6/2002 |
| AU | 2002339239 | | 7/2003 |
| AU | 2004203516 | A1 | 2/2005 |
| AU | 2005100116 | B4 | 3/2005 |
| AU | 2004240183 | A1 | 7/2006 |
| AU | 2004240184 | A1 | 7/2006 |
| AU | 2004242515 | B2 | 7/2006 |
| AU | 2006308493 | B2 | 5/2007 |
| AU | 2009100060 | A4 | 2/2009 |
| AU | 2009203058 | A1 | 8/2009 |
| AU | 2009249940 | | 11/2009 |
| AU | 2011200169 | A1 | 3/2011 |
| AU | 2011201840 | A1 | 5/2011 |
| AU | 2013204078 | A1 | 12/2012 |
| AU | 2013204078 | | 12/2013 |
| BG | 707370 | | 11/1967 |
| BG | 888703 | | 5/1981 |
| CH | 508565 | | 11/1967 |
| CH | 674826 | A5 | 7/1990 |
| CH | 675567 | A5 | 10/1990 |
| DE | 2722547 | A1 | 11/1978 |
| DE | 3045412 | A1 | 7/1980 |
| DE | 2932750 | A1 | 3/1981 |
| DE | 2933802 | A1 | 3/1981 |
| DE | 3016927 | A1 | 11/1981 |
| DE | 3043496 | A1 | 6/1982 |
| DE | 30416927 | A1 | 6/1982 |
| DE | 3043734 | A1 | 7/1982 |
| DE | 3107896 | A1 | 9/1982 |
| DE | 3149288 | A1 | 8/1983 |
| DE | 3206057 | A1 | 9/1983 |
| DE | 3239441 | A1 | 5/1984 |
| DE | 3246126 | A1 | 6/1984 |
| DE | 3307412 | A1 | 9/1984 |
| DE | 3326894 | A1 | 2/1985 |
| DE | 3440553 | A1 | 3/1985 |
| DE | 3339686 | A1 | 5/1985 |
| DE | 3425233 | A1 | 1/1986 |
| DE | 3442921 | A1 | 6/1986 |
| DE | 34942921 | A1 | 6/1986 |
| DE | 3621933 | A1 | 1/1988 |
| DE | 3634445 | A1 | 4/1988 |
| DE | 258710 | A3 | 8/1988 |
| DE | 3729065 | A1 | 3/1989 |
| DE | 3801747 | A1 | 8/1989 |
| DE | 3922815 | A1 | 2/1990 |
| DE | 3907876 | A1 | 9/1990 |
| DE | 4038517 | A1 | 6/1991 |
| DE | 4121541 | A1 | 2/1992 |
| DE | 4122000 | C1 | 10/1992 |
| DE | 4219213 | A1 | 3/1993 |
| DE | 4332216 | A1 | 6/1994 |
| DE | 102005022015 | A1 | 11/2006 |
| DE | 102009051964 | B3 | 6/2011 |
| EP | 0310686 | A1 | 9/1987 |
| EP | 03100686 | A1 | 9/1987 |
| EP | 0476435 | A1 | 9/1991 |
| EP | 1004874 | A2 | 10/2000 |
| EP | 1044874 | A2 | 10/2000 |
| FR | 2510968 | | 2/1983 |
| FR | 2539377 | A1 | 7/1984 |
| FR | 2546243 | A1 | 11/1984 |
| FR | 2576867 | A1 | 8/1986 |
| FR | 2594785 | A1 | 11/1987 |
| FR | 2698673 | A1 | 11/1987 |
| FR | 2613312 | A1 | 10/1988 |
| FR | 2639897 | A1 | 6/1990 |
| FR | 2659931 | A1 | 9/1991 |
| FR | 2667292 | A1 | 4/1992 |
| FR | 2718705 | A1 | 10/1995 |
| FR | 2744981 | A1 | 8/1997 |
| FR | 279280 | A1 | 10/2000 |
| FR | 2792280 | A1 | 10/2000 |
| FR | 2823117 | A1 | 10/2002 |
| FR | 2882338 | A1 | 8/2006 |
| FR | 2885875 | A1 | 11/2006 |
| GB | 2010189 | A | 6/1979 |
| GB | 2227461 | A | 8/1990 |
| JP | 2003306195 | | 10/2003 |
| JP | 2005074026 | | 3/2005 |
| JP | 2005112206 | | 4/2005 |
| JP | 2006280839 | | 10/2006 |
| WO | 8201694 | A1 | 5/1982 |
| WO | 8503237 | A1 | 8/1985 |
| WO | 8504141 | A1 | 9/1985 |
| WO | 8807883 | A1 | 10/1988 |
| WO | 8809286 | A1 | 12/1988 |
| WO | 9002589 | A1 | 3/1990 |
| WO | 9013472 | A1 | 11/1990 |
| WO | 9115395 | A1 | 10/1991 |
| WO | 9117080 | A1 | 11/1991 |
| WO | 9308074 | A1 | 4/1993 |
| WO | 9531366 | A1 | 11/1995 |
| WO | 9738895 | A1 | 10/1997 |
| WO | 9746444 | A1 | 12/1997 |
| WO | 9921755 | A1 | 5/1999 |
| WO | 9944884 | A1 | 9/1999 |
| WO | 0030725 | A1 | 6/2000 |
| WO | 0030925 | A1 | 6/2000 |
| WO | 0032466 | A1 | 6/2000 |
| WO | 0170565 | A1 | 9/2001 |
| WO | 0032466 | A1 | 6/2002 |
| WO | 0247971 | A1 | 6/2002 |
| WO | 03002405 | A1 | 1/2003 |
| WO | 0304203 | A1 | 5/2003 |
| WO | 03042031 | A1 | 5/2003 |
| WO | 03057559 | A1 | 7/2003 |
| WO | 03095301 | A1 | 11/2003 |
| WO | 03099650 | A1 | 12/2003 |
| WO | 2004035377 | A1 | 4/2004 |
| WO | 0132499 | A2 | 5/2004 |
| WO | 200505058 | A1 | 9/2005 |
| WO | 2005085058 | A1 | 9/2005 |
| WO | 2005105566 | A1 | 11/2005 |
| WO | 2006021029 | A1 | 3/2006 |
| WO | 2006077470 | | 7/2006 |
| WO | 2006077470 | A2 | 7/2006 |
| WO | 2006112871 | A2 | 10/2006 |
| WO | 2006123054 | A1 | 11/2006 |
| WO | 2006135256 | A1 | 12/2006 |
| WO | 2007045059 | A1 | 4/2007 |
| WO | 2007048172 | A1 | 5/2007 |
| WO | 2008006144 | A1 | 1/2008 |
| WO | 2009021267 | | 2/2009 |
| WO | 2009021267 | A1 | 2/2009 |
| WO | 2009023933 | A2 | 2/2009 |
| WO | 2009070852 | A1 | 6/2009 |
| WO | 2009076706 | A1 | 6/2009 |
| WO | 2009100479 | A1 | 8/2009 |

(56) References Cited

FOREIGN PATENT DOCUMENTS

| | | | |
|---|---|---|---|
| WO | 2009142479 | | 11/2009 |
| WO | 2009142479 | A1 | 11/2009 |
| WO | 2010022904 | A2 | 3/2010 |
| WO | 2010115242 | A1 | 10/2010 |
| WO | 2010128870 | A1 | 11/2010 |
| WO | 2011050378 | A2 | 5/2011 |
| WO | 2014008529 | A1 | 1/2014 |

OTHER PUBLICATIONS

Extracts from www.surffcs.com.au.
Futures Fins Australia 2008 catalogue.
Future Fins Advertisement Sep. 2002.
Future Fins Advertisement Nov. 2002.
Zak Surfboards Blog Oct. 29, 2010 (accessed at http://zaksurfboards.com/future-fins/).
Pullen, Mark. "Statement of Grounds and Particulars." Sep. 17, 2016. Australia.
Seabase, "The New Universal Surfinz F3", Seabase Installation Instruction Sheet, www.seabase.eu, Whole Document.
Speeedsurf, "MultiPlug Fitting Instructions", www.speeedsurf.com.au, Whole Document.

SECTION A-A

SECTION A-A

SECURING MECHANISM FOR WATER CRAFT FIN

CROSS-REFERENCE TO RELATED APPLICATIONS

This is a continuation-in-part application of both Patent Application Number PCT/AU2015/050092, filed Mar. 9, 2015, and U.S. patent application Ser. No. 14/411,667, filed Dec. 29, 2014. The priority of both applications is hereby claimed, and both applications are incorporated herein by reference. Application Number PCT/AU2015/050092 claims the priority of Australian Patent Application Number 2014900816 filed Mar. 11, 2014. U.S. patent application Ser. No. 14/411,667 is a national stage entry of Application Number PCT/AU2013/000738, filed Jul. 5, 2013, which claims the priority of Australian Patent Application Number 2012902939 filed Jul. 9, 2012.

FIELD OF THE INVENTION

The present invention relates to a securing arrangement for securing a water craft fin to a water craft having a fin plug, for installation in a water craft, such as a surfboard or the like, adapted to enable fins to be removably attached to the water craft.

The present invention also relates to fins or other items which are adapted to be removably attached to water craft.

BACKGROUND OF THE INVENTION

A water craft, such as a surfboard, particularly one on which a person stands, kneels or sits, when traversing water or riding a wave, generally has at least one fin in an underside of the water craft, generally near the tail end of the water craft. Such fins have a number of functions, including: enabling the craft to travel in a desired direction; facilitating the turning of the craft; preventing the craft from slipping sideways; and providing greater control over the movement of the craft, such as when riding a wave.

The following discussion is directed mainly to surfboards but it is to be understood that the discussion applies equally to other water craft (and surf craft) which are adapted to include fins, such as sail boards, paddle boards, rescue boards, surf skis, kayaks, and the like.

Some surfboards have fins integrally formed in the underside of the surfboard and, historically, most surfboards included such integrally formed fins. These integrally formed fins are generally 'glassed in', meaning that they are formed as part of the surfboard by means of fiber-reinforced resin. The formation of such 'glassed in' fins is quite labour intensive and it makes the subsequent sanding and finishing of the board more difficult.

In the last twenty years or so, it has become more common for surfboards to incorporate fin systems which include removable fins. Such fin systems have numerous benefits, including: enabling the fins to be removed whilst travelling; allowing damaged fins to be easily replaced; and enabling fins of different shapes or styles to be selectively used. These fin systems typically include at least one fin plug embedded in the underside of the surfboard, adapted to receive at least one surfboard fin. Each such fin plug will generally include an open cavity adapted to receive a base portion (or base element) of a surfboard fin. The fin is then able to be removably attached to the surfboard by inserting the relevant base portion (or base element) of the fin into the cavity (or cavities) of the fin plug (or fin plugs). There are numerous known fin systems which incorporate such an arrangement.

One known and commonly used fin system is described in U.S. Pat. No. 5,464,369 in the name of Fin Control Systems Pty Ltd. This system includes fins, each having two projecting base elements (or tabs) and, for each fin, two fin plugs installed in the underside of the surfboard. Each of the fin plugs has a cavity for receiving one of the base elements. Each fin plug also includes a grub screw for securing the base element within the cavity of the fin plug.

The above fin system of U.S. Pat. No. 5,464,369 has become exceedingly popular and widely used as the system enables fins to be affixed to a surfboard in a highly secure manner whilst also enabling the fins to be easily removed from the surfboard when desired. However, one drawback of the abovementioned system is that the installation and removal of fins from the fin plugs is somewhat time-consuming and requires the use of a tool (e.g. an Allen key) as the grub screws need to be threaded into or out of each cavity in order to secure or release the base elements of each fin (as desired).

Another fin plug which functions in a similar way to that described above is the fin plug assembly described in PCT/AU/2008/001132, also in the name of Fin Control Systems Pty Ltd. The fin plug described in PCT/AU/2008/001132 includes two open cavities adapted to receive corresponding base elements of a surfboard fin. These base elements are adapted to be secured and released by means of grub screws (which can be threaded into or out of the cavities). Each such grub screw is adapted to press laterally against a side of a base element of the fin to secure it in position.

Other known fin systems include systems which incorporate a single fin plug, with a single cavity, for each surfboard fin. Typically, such a fin system has quite a large fin plug with an elongated fin cavity for receiving the base element(s) of a fin. In such fin systems it is again usual for each fin to be secured to the surfboard (that is, the base element of the fin to be secured within the cavity of the fin plug) by means of a grub screw arrangement, such as that mentioned above. There is a present need for a water craft fin securing mechanism adapted to enable fins to be removably secured to the underside of a water craft in a quick, easy and secure manner and preferably without the need for using a tool.

International Patent Application PCT/AU2013/000738 (WO 2014/008529) by the present Applicant discloses a securing mechanism for securing a water craft fin, hook or similar to a water craft, including a securing arrangement comprising a resilient biasing rod and a protruding member cooperating with the biasing rod. The protruding member actuates when the base portion of said fin when received in said first open cavity so that the biasing rod and protruding member apply a force to the base portion of said fin to inhibit removal of the fin from the open cavity.

International Patent Application PCT/AU2013/001314 by the present Applicant discloses a modified fin plug construction providing an improved bond with the water craft, and in some embodiments may employ the fin securing mechanism of WO 2014/008529.

The present disclosure aims to build on the disclosure of WO 2014/008529 to provide alternative forms of securing mechanisms.

The contents of WO 2014/008529 and PCT/AU2013/001314 are incorporated herein by reference.

Further, the present invention is directed towards fins or other items which are adapted to be easily and quickly secured to or removed from the abovementioned fin plugs without the use of a tool.

In this specification, where a document, act or item of knowledge is referred to or discussed, this reference or discussion is not an admission that the document, act or item of knowledge or any combination thereof was at the priority date:

a) part of the common general knowledge; or b) known to be relevant to an attempt to solve any problem with which this specification is concerned.

Any reference herein to known prior art does not, unless the contrary indication appears, constitute an admission that such prior art is commonly known by those skilled in the art to which the invention relates, at the priority date of this application.

SUMMARY OF THE INVENTION

According to a first form of the present disclosure, there is provided a securing arrangement for securing a water craft fin to a water craft having a fin plug, the fin plug having a first open cavity adapted to receive a base portion of the water craft fin; the securing arrangement comprising a resilient biasing rod and a protruding member cooperating with the biasing rod, said protruding member being adapted to actuate when the base portion of said fin when received in said first open cavity so that the biasing rod and protruding member apply a force to the base portion of said fin to inhibit removal of said fin from said first open cavity.

The biasing rod may extend substantially parallel to a side surface of the base portion of said fin.

In a first example form, the biasing rod and protruding member are incorporated in the fin, preferably in a base portion of the fin, to cooperate with a fin plug of the water craft.

The biasing rod and protruding member may be incorporated in a cartridge assembly which is fitted in a cavity formed in the fin base. Preferably the cartridge assembly includes a cartridge body with a cavity in which the biasing rod and protruding member are supported.

In a further example form, the invention provides a fin adapted for installation in a fin plug of a water craft, said fin plug including a first open cavity adapted to receive a base portion of the water craft fin, wherein the fin includes:

a resilient biasing rod and a protruding member cooperating with the biasing rod, said protruding member being adapted to protrude from the fin base portion when actuated by the biasing rod, to engage with the fin plug and apply a force to the base portion of said fin to inhibit removal of said fin from said first open cavity.

The biasing rod generally extends substantially parallel to a side surface of the base portion of said fin. It is preferred that the orientation of the biasing rod is also substantially parallel to the plane of the water craft.

The biasing rod may be formed of any suitable material, such as titanium, steel (e.g. marine grade steel), fiberglass, carbon fibre or plastic (including reinforced engineering plastic). It is particularly preferred that the biasing rod is formed of titanium.

The protruding member is preferably adapted to abut a side surface of the fin plug cavity.

In a particularly preferred embodiment, a side surface of the first cavity of the fin plug includes a lateral recess portion being adapted to co-operate with the protruding member so as to retain the fin in the fin plug cavity. Preferably, the biasing rod will cause the protruding member to 'snap-fit' into the lateral recess of the fin plug cavity when the fin base portion is pushed into the cavity.

The fin and fin plug will typically have a forward region and a rearward region and the fin plug will preferably include additional fin removal inhibiting means located in said forward region. Preferably, the protruding member is located in the rearward region.

The additional fin removal inhibiting means preferably includes fin engagement means. The fin engagement means preferably includes a slot or groove to receive a lateral projection such as a transverse pin on a forward portion of the fin base.

In another form of the disclosure, the securing mechanism may be incorporated in the fin plug, generally as described in WO 2014/008529.

In a particularly preferred embodiment, the protruding member is a ring-shaped member located about said biasing rod. Preferably, this ring-shaped member is adapted to rotate about said biasing rod. The ring-shaped member preferably has a circumferential outer surface extending between two side surfaces, said circumferential outer surface having a convex profile between said side surfaces. This convex profile enables the load or force, which is applied to the ring-shaped member when it engages with the side surface of the water craft fin plug, to be dispersed more evenly across the ring shaped member. The ring shaped member preferably rolls or rotates so as to reduce friction wear on the plug and facilitate a "smoother" installation and removal of the fin from the plug.

The ring-shaped member is typically formed of a durable, non-corrosive polymer/plastic material (although a number of other suitable materials could be used). Acetal is a particularly preferred material for the ring-shaped member. Acetal is a common term for a comparatively hard engineering plastic with high tensile strength, suitable for machining and high rigidity in use.

Typically, the embodiments of this invention where the biasing rod and protruding member are formed in the fin are adapted for installation in a larger surf craft, such as a longboard or a stand-up paddle board, which will typically have relatively thick fins with thicker fin base portions to accommodate the mechanism. However, the fin-mounted embodiment may be used for relatively smaller shortboard fins as well, for example with adaption of the fin base portion to be thicker than the body of the fin, with corresponding change in breadth of the cavity of the fin plug. According to a second aspect of the present disclosure, there is provided a water craft fin plug adapted to receive a fin plug according to the above embodiment of the disclosure.

According to a third aspect of this disclosure, there is provided fin plug and a water craft fin kit, for use in a surf craft, including a fin plug as described above and a water craft fin as described above.

According to a fourth aspect of the present disclosure, there is provided a water craft attachment device having a base portion including a securing mechanism as described above.

In a preferred embodiment, the water craft attachment device includes a support connecting element for connecting the attachment device to a support structure. This support connecting element may include a hook element for connecting the water craft attachment device to a support rod (e.g. a horizontal support rod). The support connecting element, such as a hook element, may be separated from the base portion of the water craft attachment device by an intermediate section of the attachment device.

In a further, particularly preferred embodiment of this aspect of the invention, the hook element lies in a plane which is at right angles to the plane of the base portion.

Typically, the water craft attachment device described above will be adapted for use in a surfboard or other surf craft.

The above preferred embodiment of the fourth aspect of the present disclosure enables a water craft attachment device, which includes a hook element, to be attached to a surfboard (or other water craft), which then enables the surfboard (or other water craft) to be suspended from a supporting rod (e.g. a horizontal support rod). In the above-mentioned preferred embodiment, in which the hook element lies in a plane which is at right angles to the plane of the base portion, this enables a multitude of surfboards to be suspended from the supporting rod in a sandwiched formation, thereby enabling a greater number of surfboards to be stored on the supporting rod.

As will be appreciated from the above discussion (and as further explained and illustrated later in this specification), a water craft fin or other water craft attachment device, according to the above relevant descriptions, can readily be attached to a fin plug, according to the above relevant description.

This attachment is effected, in the case of a water craft fin, by inserting the base portion of the fin into the first open cavity of the fin plug. This is typically achieved by engaging a forward portion of the fin (e.g. the fin section) with the fin engagement means of the fin plug and then rotating a rearward portion of the fin down towards the fin plug, so that the base portion of the fin extends into the open cavity, thereby enabling the protruding means of this base portion to protrude into lateral recess of the fin plug cavity.

In the case of another water craft attachment device, such as a hook element (as described above), the attachment is effected by inserting the base portion of the attachment device into the first open cavity of the fin plug. This is typically achieved by engaging a forward portion of the attachment device with the fin engagement means of the fin plug and then rotating a rearward portion of the attachment device down towards the fin plug, so that the securing mechanism of the base portion of the attachment device operates as described above In the above embodiments, the biasing rod and protruding member may be respectively a resilient elongate member a bulbous portion. The bulbous portion can be part of a wheel-like member formed around the elongate rod, the wheel-like member being configured to rotate about the rod when the fin and fin plug engage, during installation and/or removal of the fin, to hold the fin base portion in the fin plug cavity once the fin is installed.

The biasing rod and protruding member will be incorporated in one of the fin or the fin plug, with the other of the fin or the fin plug having a grooved portion (or an inclined portion), the grooved portion (or inclined portion) being configured to engage with the extending portion.

A surface of the wheel-like member can be is configured to sit within the grooved portion (or against the inclined portion).

Further forms and embodiments of the disclosure will also be apparent from the description and drawings, and from the claims.

It will be appreciated that the features described herein can be provided in the device described herein either independently or in different combinations.

BRIEF DESCRIPTION OF THE DRAWINGS

A detailed description of a preferred embodiment of a securing mechanism incorporated in device/fin plug according to the first aspect of this invention is given hereinafter, while referring to the following figures:

FIG. 1B shows the tangent edges with dashed lines. This embodiment is in common to the present disclosure and to WO 2014/008529.

FIGS. 12A to 15D illustrate an alternative arrangement, in which the securing mechanism is incorporated in the fin base portion;

FIGS. 12A to 12C is a series of views showing construction and assembly of a cartridge incorporating the securing mechanism components, adapted for fitting into a fin base portion or other device;

FIG. 15D is a section showing the off-centre position of the securing mechanism within the fin base, and the engagement with the fin plug;

DETAILED DESCRIPTION OF THE EMBODIMENT OR EMBODIMENTS

Figure 1A:
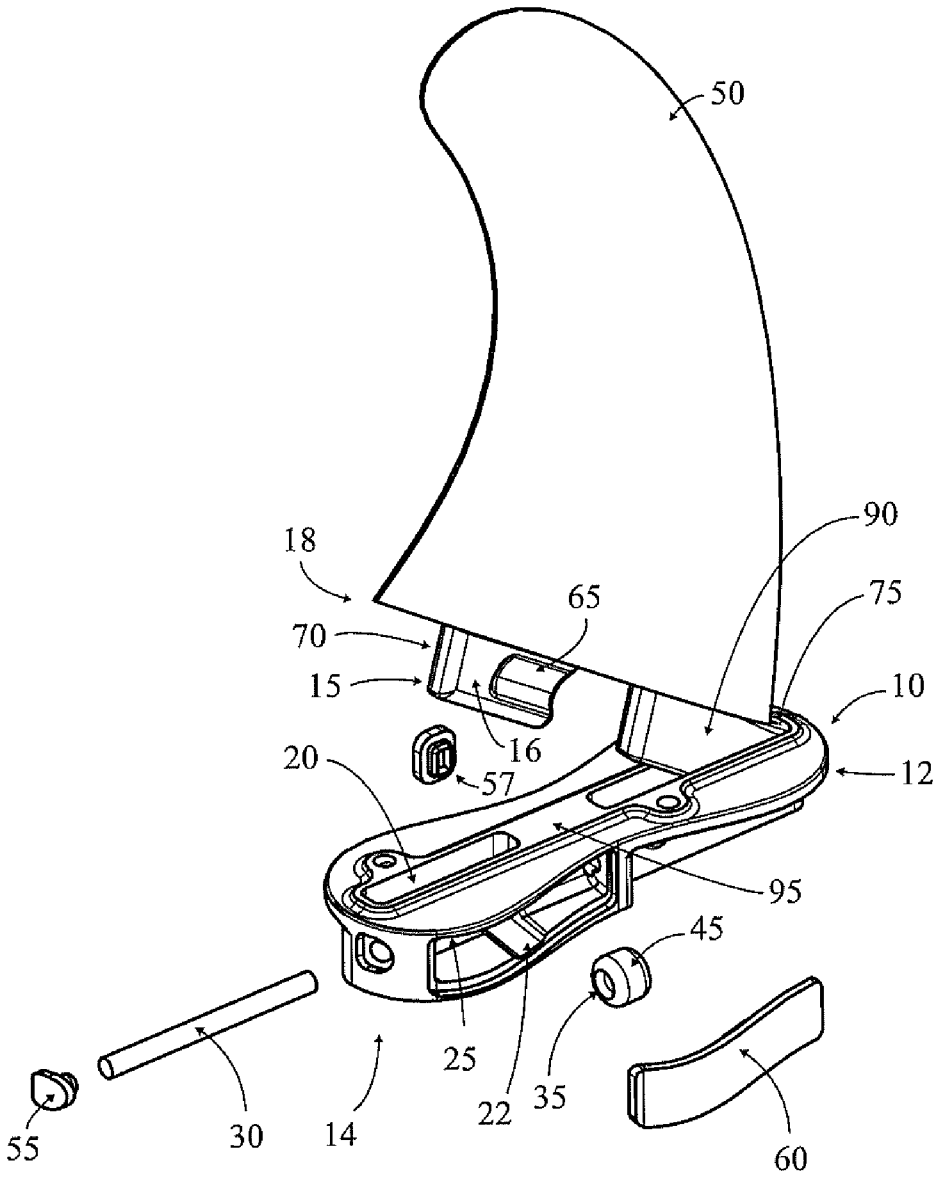
FIGS. 1A and 1B are perspective (exploded) views of an example fin and fin plug assembly.
Figure 1B:
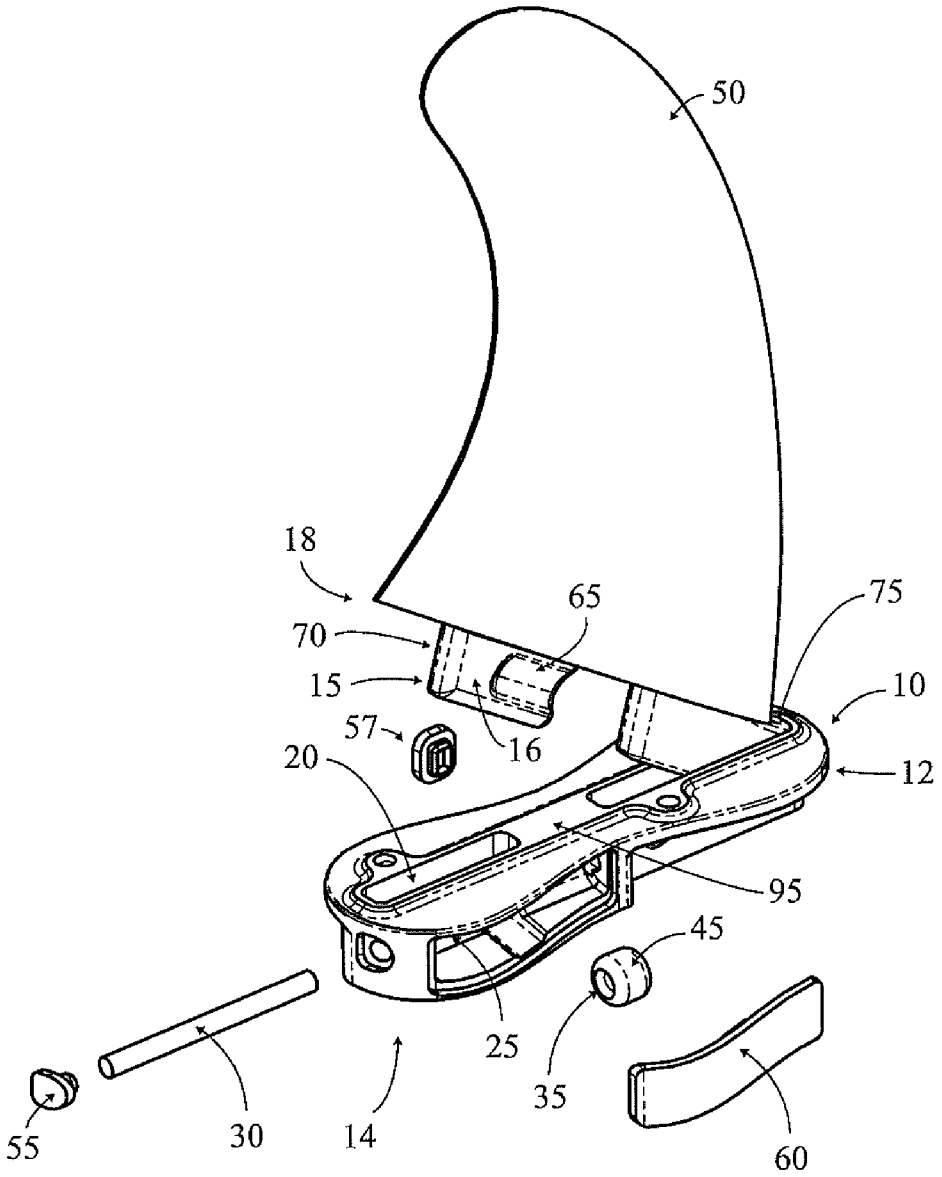

An example of a securing mechanism incorporated in a device or fin plug 10 is shown in FIGS. 1A and 1B.

In this particular example, the device 10 is used for holding a first fin portion 15 in a water craft, such as a surfboard or the like (not shown). The device 10 can be formed such that it is integral or insertable into the water craft.

As shown in FIGS. 1A and 1B, the device 10 can include a first cavity 20, having a cavity wall 25 (and further described below). The device 10 also includes a resilient elongate member 30, which can be located at least partially along an elongate side of the cavity wall 25. FIG. 1 also shows that the resilient elongate member 30 can have an extending portion 35, where the extending portion 35 extends from the resilient member 30 through a recess 40 or aperture in the elongate side of the cavity wall 25, Accordingly, when the first fin portion 15 is inserted into the first cavity 20, any one or a combination of the resilient elongate member 30 and the extending portion 35 can apply a force to the first fin portion 15 to hold the first fin portion 15 within the first cavity 20.

Thus, in one particular example, the resilient elongate member 30 is a resilient rod or pin, and the extending portion 35 can includes a bulbous portion 45, where the bulbous portion 45 is configured to engage with the first fin portion 15. In yet a further example, the bulbous portion 45 can be a part of a wheel-like member formed around the elongate rod 30, where the wheel-like member 35 is configured to move around the rod 30 when engaging with the first fin portion 15, to hold the first fin portion 15 in the first cavity 20.

FIGS. 1A and 1B, for example, show that the rod 30 is a pin, or the like, which can act as a spring to allow the wheel-like member 35, to act as a barrel, which can hold the fin 50 in place. Thus the device 10 can be in the form of a box which can hold the fin and hold the pin in place. FIG. 1 also shows that once the rod 30 is inserted into the device 10, the insertion can be sealed by an end plug 55, or the like. The plug 55 can prevent the rod 30 moving out of the device 10.

Additionally, FIGS. 1A and 1B also show that the device 10 can include one or more caps 55, 57, 60, which can be used to seal the extending portion 35 into the device 10. In one particular example, the end cap 55 is typically water tight and can hold both the rod 30 and the extending portion 35 therein. The side cap 57 can be optional, the rod 30 and the extending portion 35 can be installed without the use of an aperture that side cap 57 seals. FIG. 6N illustrates an embodiment of the fin plug 10 without the use of a side cap 57.

According to yet a further example, the first fin portion 15 can also include a grooved portion 65 on a side fin surface 70. The grooved portion 65 is typically configured to engage with the extending portion 35. Thus, in one example, a surface of the wheel-like member 35, which is typically a curved surface, is configured to site within the grooved portion 65.

It will be appreciated that although the grooved portion 65 can be formed or shaped such that it substantially conforms or mates with the curved surface of the extending portion 35, strict conformance or mating is not necessary. In these examples, the grooved portion 65 is configured to roll over the extending portion 35 and the extending portion 35 can then lock the first fin portion 15 into the first cavity 20. It will also be appreciated that when the locking action occurs and the first fin portion 15 is pushed into the cavity, the rod 30 may bend and may remain slightly bent when applying the force to the extending portion 35, which subsequently applies a force to the grooved portion 65, in order to maintain the first fin portion 15 within the first cavity 20. In one particular example, either a lateral or a downward force, or a combination thereof can be applied to maintain the first fin portion 15 within the device 10.

According to one particular example, when inserting the fin 50 into the device 10, a second fin portion 90 is inserted initially, where the recess 85 on the second fin portion 90 engages with the protrusion 80 on the device 10 (within the second cavity 75). Once the second fin portion 90 is in place, the first fin portion 15 is locked into the first cavity 20 by pushing down on the fin 50 such that the groove 65 engages with the extending portion 35, which is at least partially within the first cavity 20.

Thus, in a further example, referring to FIGS. 1A and 1B, there is provided herein a fin plug 10 for installation in a water craft (not shown), said fin plug 10 including a first open cavity 20 adapted to receive a base portion 18 of a water craft fin 50; and, a resilient biasing rod 30 and a protruding member (otherwise referred to herein as an extending portion) 35 cooperating with the biasing rod 30. The protruding member 35 is adapted/configured to abut the base portion 18 of said fin 50 when received in said first open cavity 20. Accordingly, the biasing rod 30 and protruding member 35 are adapted to apply a force to the base portion 18 of said fin 50 to inhibit removal of said fin 50 from said first open cavity 20.

As shown in FIGS. 1A and 1B, the biasing rod 30, when inserted into the fin plug 10 is located adjacent the first open cavity 20. According to one particular example, the biasing rod 30 extends substantially parallel to a side surface 16 of the base portion 18 of the fin 50. Thus, the protruding member 35 can abut the side surface 16.

It will further be appreciated that the fin plug 10 can also include a lateral cavity 22 where the biasing rod 30 is located within the lateral cavity 22. Thus, the lateral cavity 22 and the first open cavity 20 are separated by an apertured wall (herein referred to as the cavity wall) and at a portion of the protruding member 35 protrudes through an aperture (or recess) 40 in the wall 25 into the first open cavity 20.

The side surface 16 can include an inclined surface section (otherwise described herein as a grooved portion) 65. The inclined surface section 65 is adapted to cooperate with the protruding member 35 so as to cause a force, inwardly into the first open cavity 20 to be applied to the base portion 18 under the influence of the biasing rod 30.

According to one particular example, the fin plug 10 can have a forward region 12 and a rearward region 14. The protruding member 35 is typically located in the rearward region 14.

The fin plug 10 can include an additional fin removal inhibiting means located in the forward region 12. The fin removal inhibiting means can include a fin engagement means which includes a ledge portion (referred to herein as the protrusion) 80 which is adapted to overlie a fin section (referred to herein as the recess) 85 and to inhibit movement of the fin 50 when the base portion 18 is received within the first open cavity 20.

As described herein, the fin plug 10 can include a second open cavity 75. Accordingly, the first open cavity 20 can receive a first tab of the base portion 18 of the fin 50 and the second open cavity 75 can receive a second tab of the base portion 18 of the fin 50. In this particular example, the first open cavity 20 is located in the rearward region 14 and the second open cavity is located in the forward region 12. Furthermore, the inclined surface section 65 of the base portion of said fin is located on the first tab. Additionally, the ledge portion 80 can be located within said second open cavity, and the fin section can be located on the second tab of the base portion of the fin 50.

The ledge portion can include a ledge extending from one end of said second open cavity and defining a recess between said ledge and a base surface of said second open cavity, said recess being adapted to receive the fin section, for example as shown in FIGS. 12A to 12H of WO 2014/008529.

As discussed herein, the extending portion/protruding member 35 can be wheel-like or a ring-shaped member located about the biasing rod 30. In one particular example, the ring-shaped member can rotate about said biasing rod. In yet a further example, the ring-shaped member does not necessarily have to be cylindrical in shape and may have a circumferential outer surface extending between two side surfaces, where the circumferential outer surface has a convex profile between said side surfaces.

In yet a further example, as particularly shown in FIGS. 2A, 3A, 4A, 4F, 5A, and 5F, the device 10 can also include a second cavity 75. The second cavity 75 can include a protrusion 80, where the protrusion 80 is configured to be inserted into and mate with a respective recess 85 of a second fin portion 90, to thereby hold the second fin portion 90 within the second cavity 75.

Thus, for example, any one or a combination of the protrusion 80 and the recess 85; and, the extending portion 35 and the first fin portion 15 can snap-lock together, and the fin 50 can be held robustly within the device 10.

Notably, it will be appreciated by persons skilled in the art that the second fin portion 90 can be held within the second cavity 75 by a number of different mechanical elements/fixing means. Further examples of fixing means for fixing/holding the second fin portion 90 into a second cavity 75 are described below.

In the examples shown in the FIGS, the first cavity 15 and the second cavity 75 are two distinct cavities within the device 10. However, it will be appreciated that they may in some instances form a part of one elongate cavity (not shown). Notably, certain advantages may be provided by maintaining the two distinct cavities. That is, the bridge 95 between the two cavities can be configured to more robustly hold the first and second fin portions 15, 90 in respective first and second cavities 20, 75. Furthermore, the bridge can include a bridge section which has an upper surface which is adapted to abut a lower surface of a water craft fin.

It will be appreciated by persons skilled in the art that many water crafts such as surfboards or the like can include one or more fins. In one particular example, a surfboard may include a central fin and two side fins (referred to herein as left and right fins, when viewing the underside of the surfboard with tail of the surfboard lowermost). Thus, although the features described herein may be applicable to any fin, the water craft may include slight variations depending on the location of the fin (whether a central fin, right fin, or left fin).

Figure 2A:
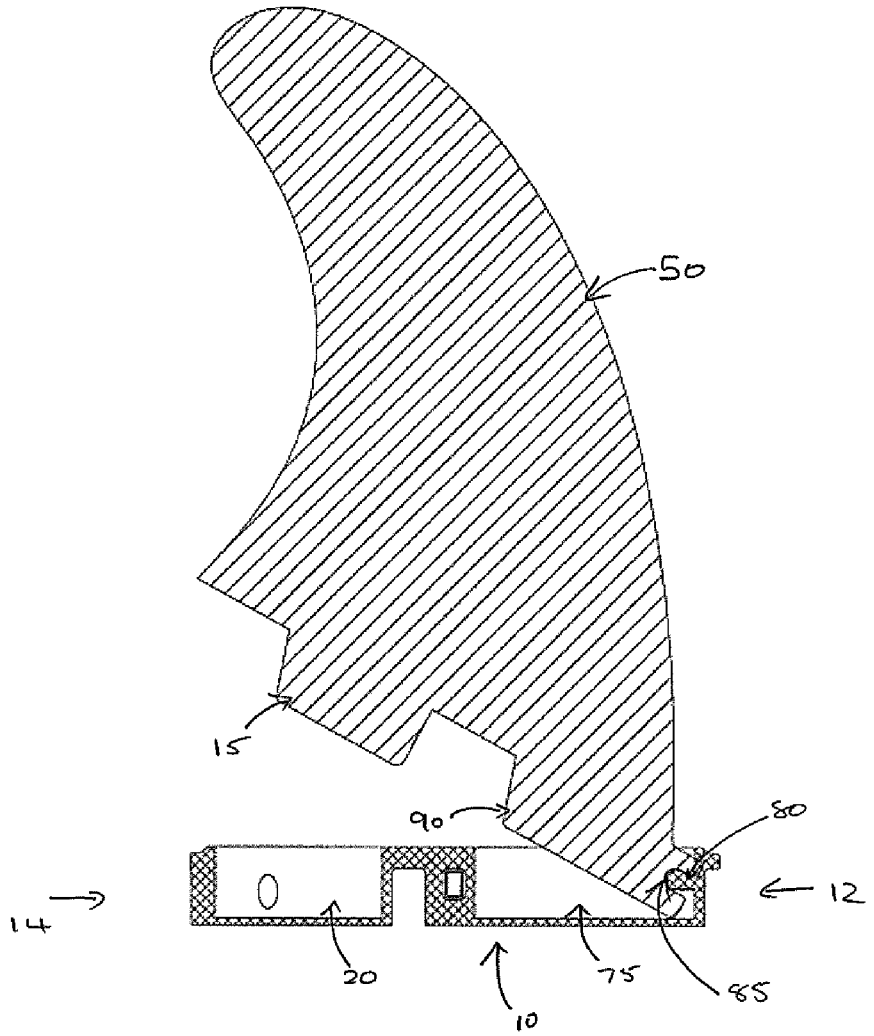
FIG. 2A is a side cross-sectional view of an example centre fin and fin plug assembly.
Figure 2B:
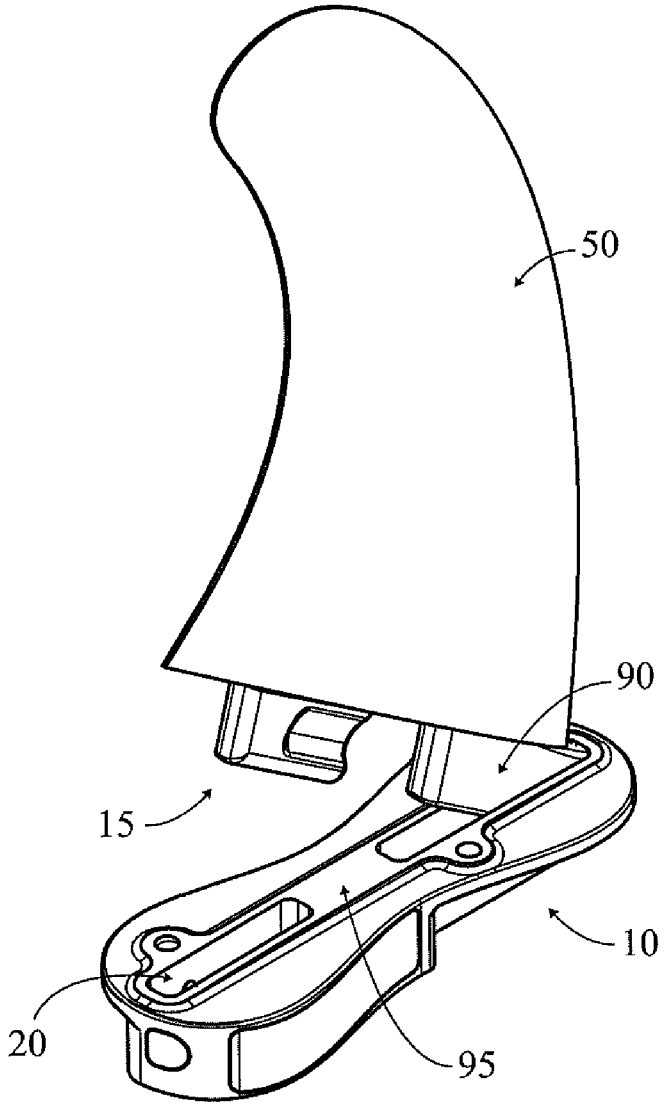
FIG. 2B is a perspective view of the fin and fin plug assembly of FIG. 2A.
Figure 2C:
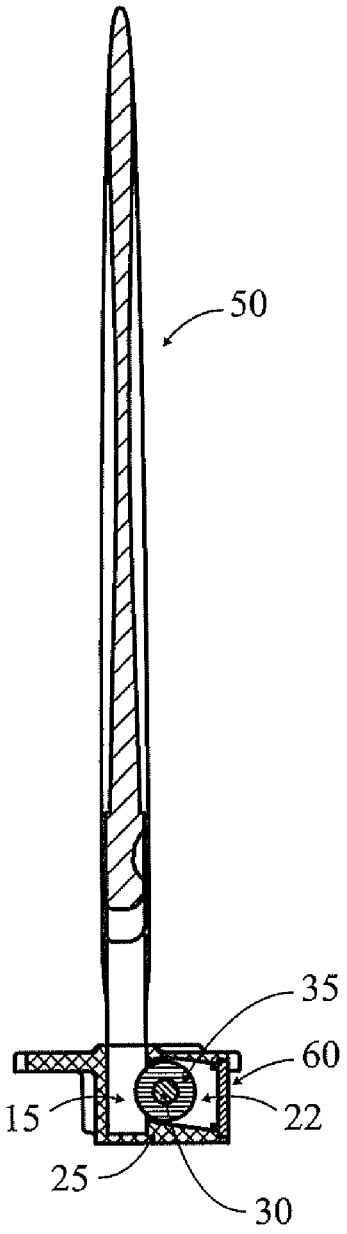
FIG. 2C is a cross-sectional front view of the fin and fin plug assembly of FIG. 2A.
Figure 2D:
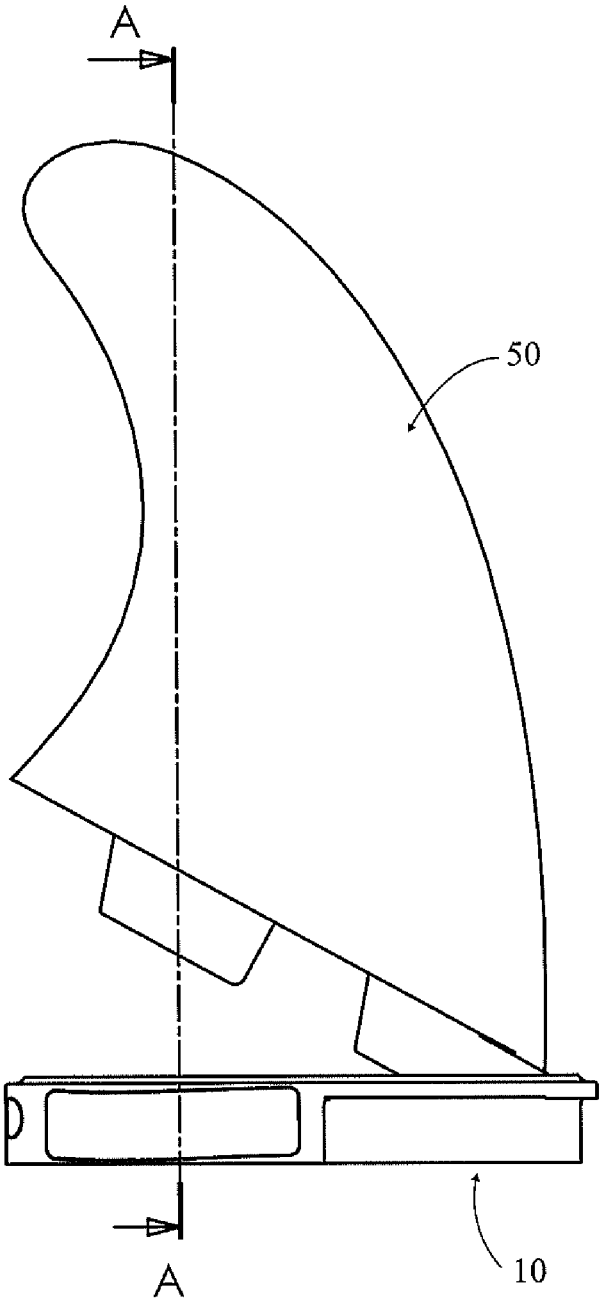
FIG. 2D is a side view of the fin and fin plug assembly of FIG. 2A.
Figure 2E:
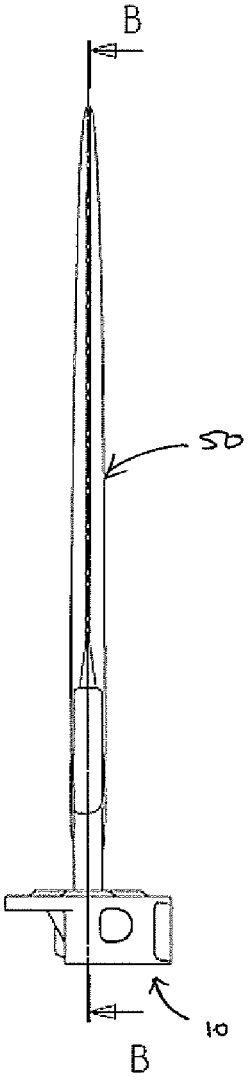
FIG. 2E is front view of the fin and fin plug assembly of FIG. 2A.
Figure 2F:
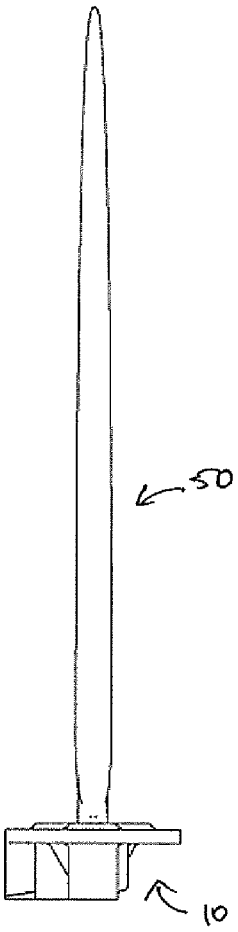
FIG. 2F is a back view of the fin and fin plug assembly of FIG. 2A.
Figure 2G:
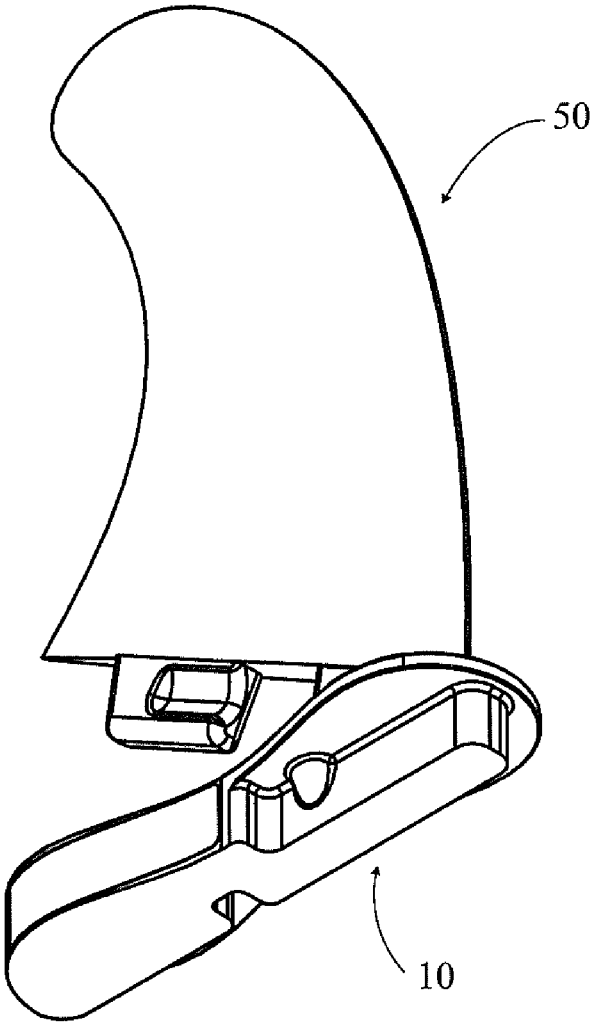
FIG. 2G is an underneath perspective view of the fin and fin plug assembly of FIG. 2A.
Figure 2H:
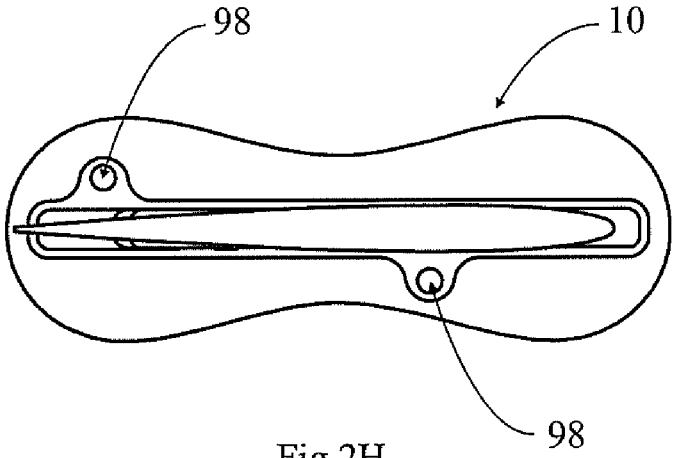
FIG. 2H is a top view of the fin and fin plug assembly of FIG. 2A.
Figure 2I:
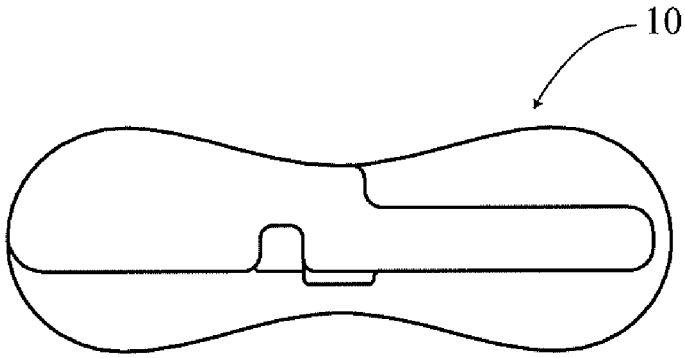
FIG. 2I is a bottom view of the fin and fin plug assembly of FIG. 2A.
Figure 3A:
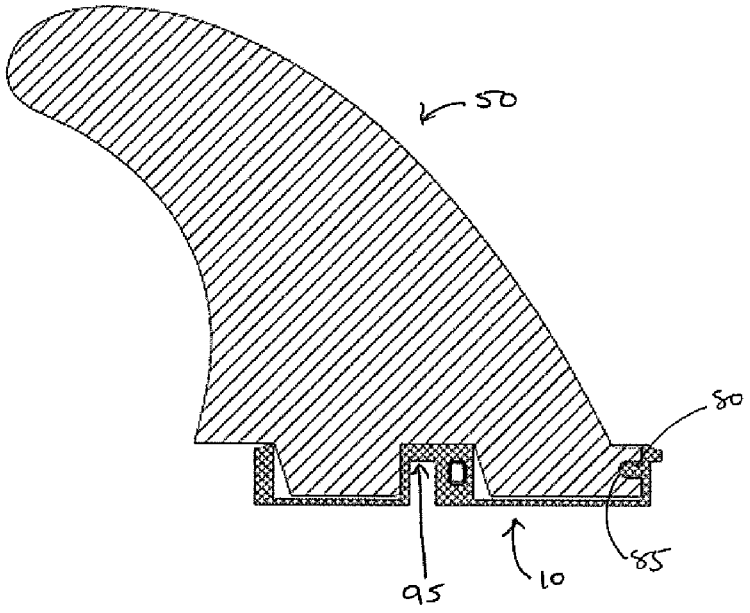
FIG. 3A is a side cross-sectional view of the fin and fin plug assembly of FIG. 2A, when the fin has been inserted into the device.
Figure 3B:
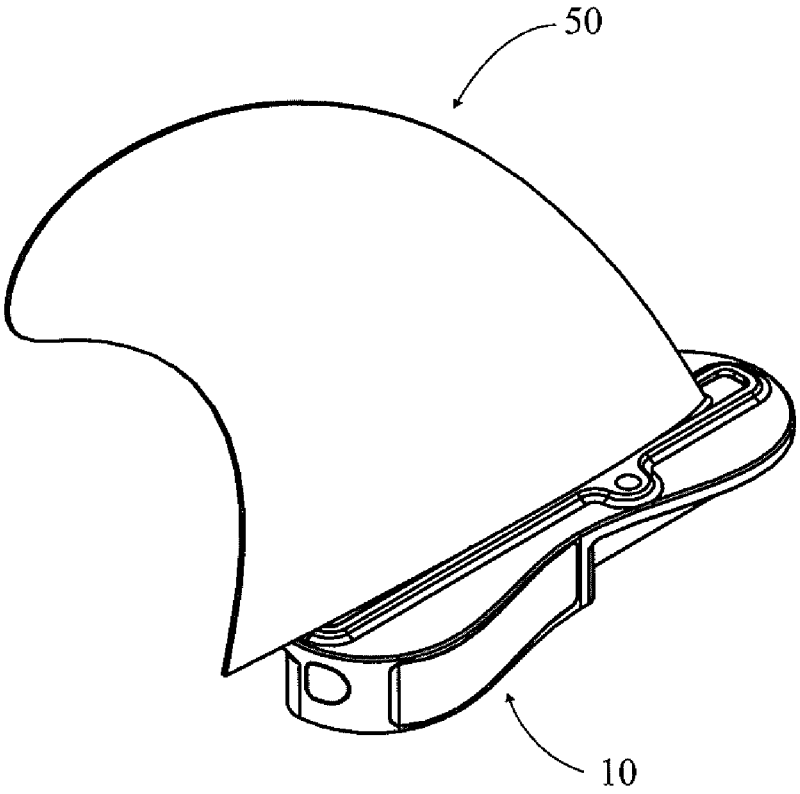
FIG. 3B is a top perspective view of the fin and fin plug assembly of FIG. 3A.
Figure 3C:
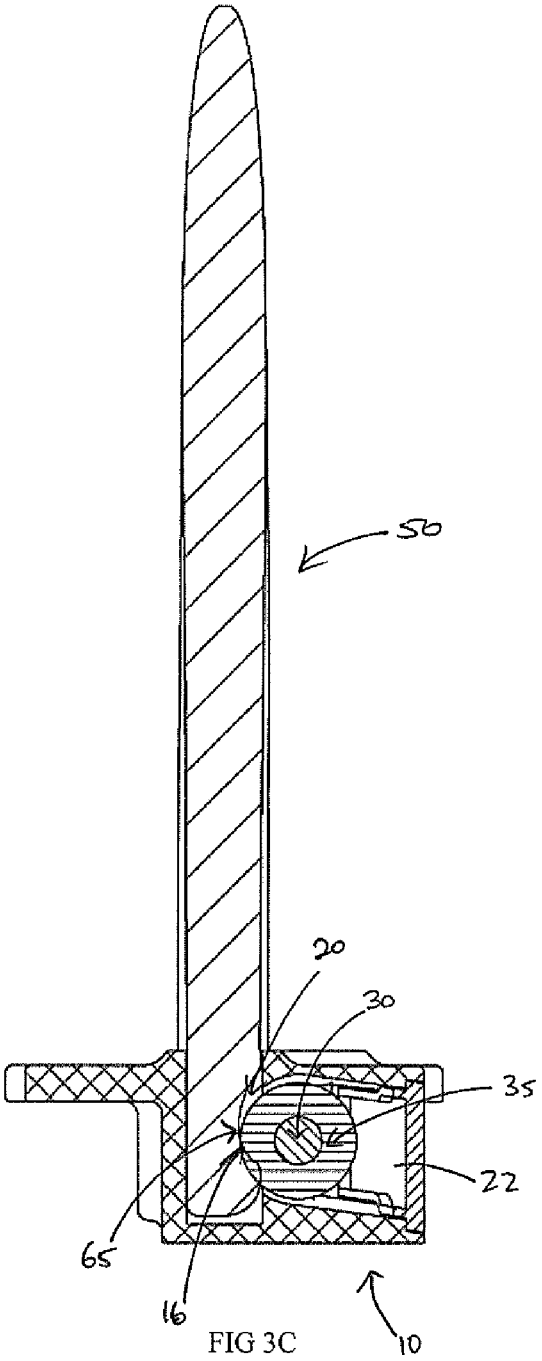
FIG. 3C is a front cross-sectional view of the fin and fin plug assembly of FIG. 3A.
Figure 4A:
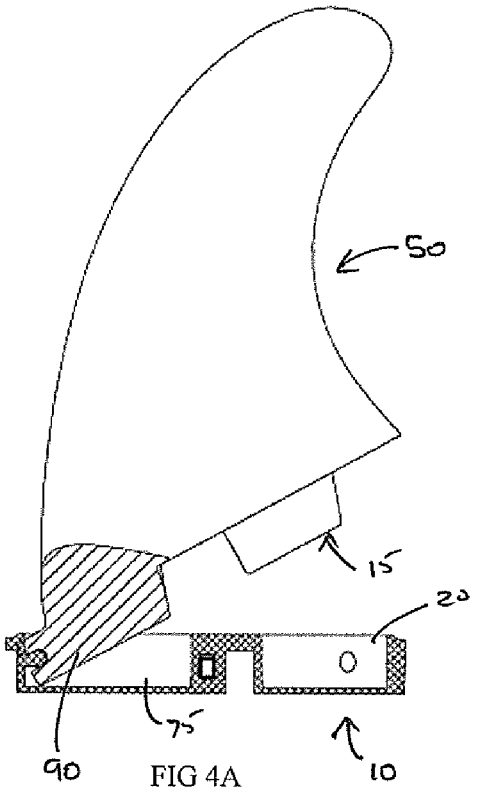
FIG. 4A is a side cross-sectional view of an example right-side the fin and fin plug assembly.
Figure 4B:
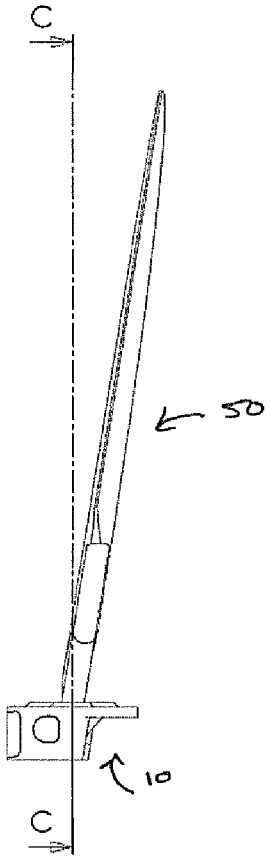
FIG. 4B is a back view of the fin and fin plug assembly of FIG. 4A.
Figure 4C:
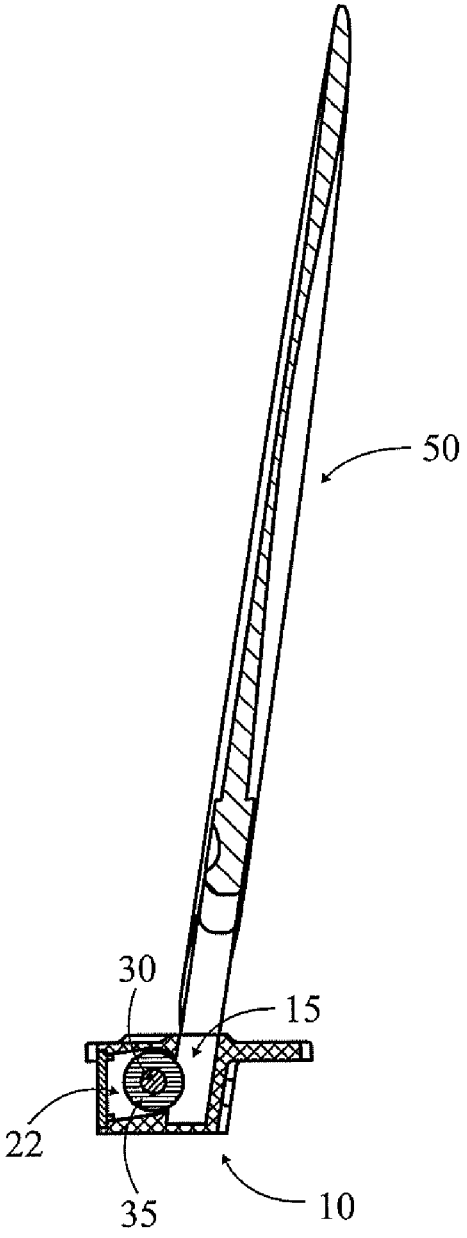
FIG. 4C is a cross-sectional front view of the fin and fin plug assembly of FIG. 4B along the line C-C.
Figure 4D:
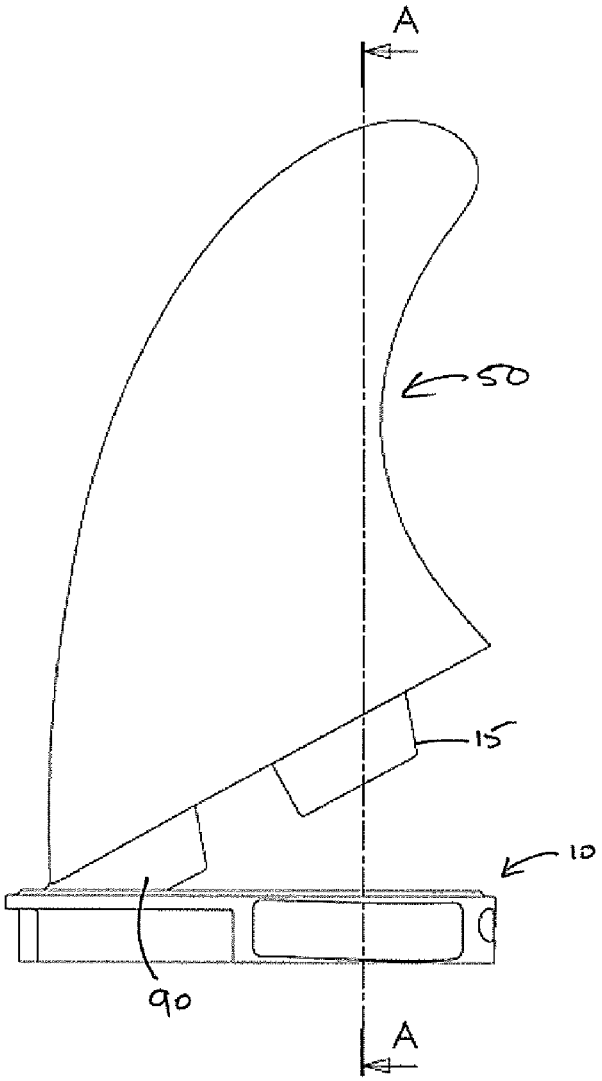
FIG. 4D is a side view of the fin and fin plug assembly of FIG. 4A.
Figure 4E:
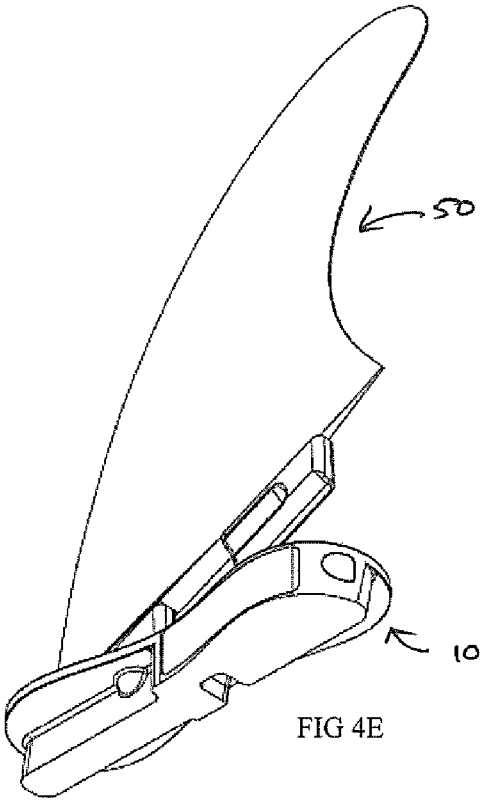
FIG. 4E is a bottom perspective view of the fin and fin plug assembly of FIG. 4A.
Figure 4F:
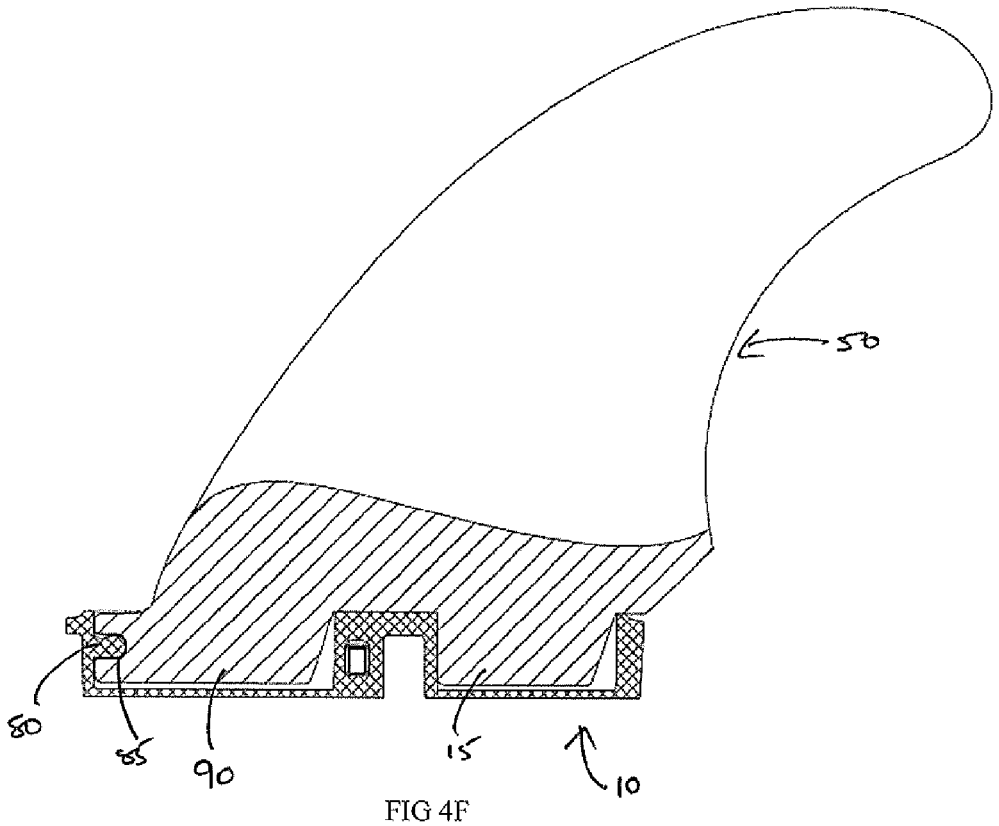
FIG. 4F is a cross-sectional side view of the fin and fin plug assembly of the FIG. 4A, the fin being received by the device.
Figure 4G:
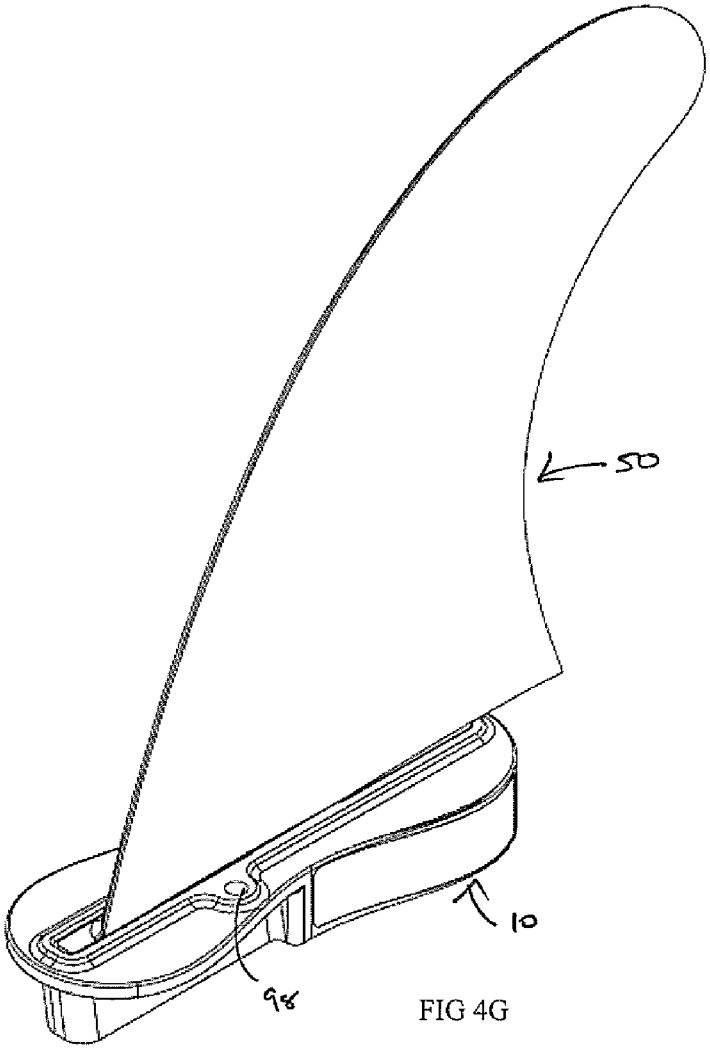
FIG. 4G is a top perspective view of the fin and fin plug assembly of FIG. 4F.
Figure 5A:
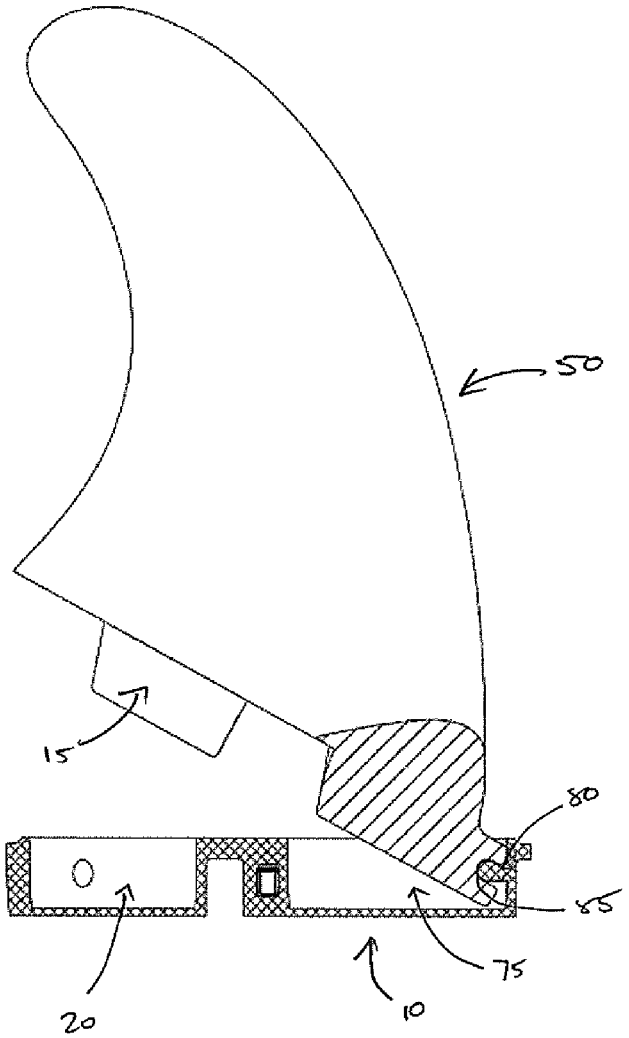
FIG. 5A is a side cross-sectional view of an example left-side of the fin and fin plug assembly.
Figure 5B:
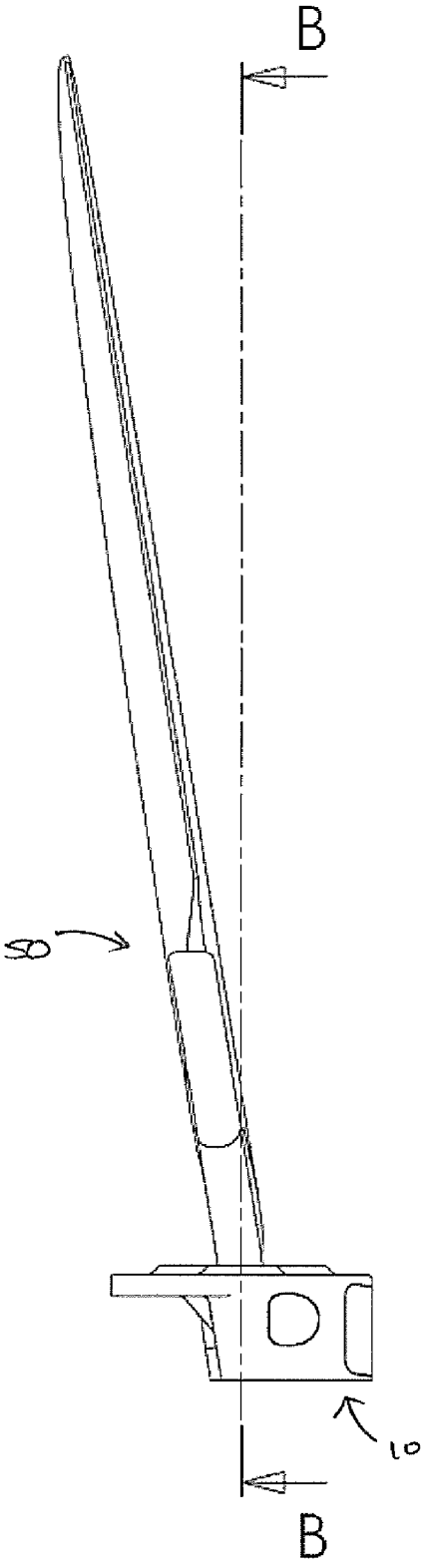
FIG. 5B is a back view of the fin and fin plug assembly of FIG. 5A.
Figure 5C:
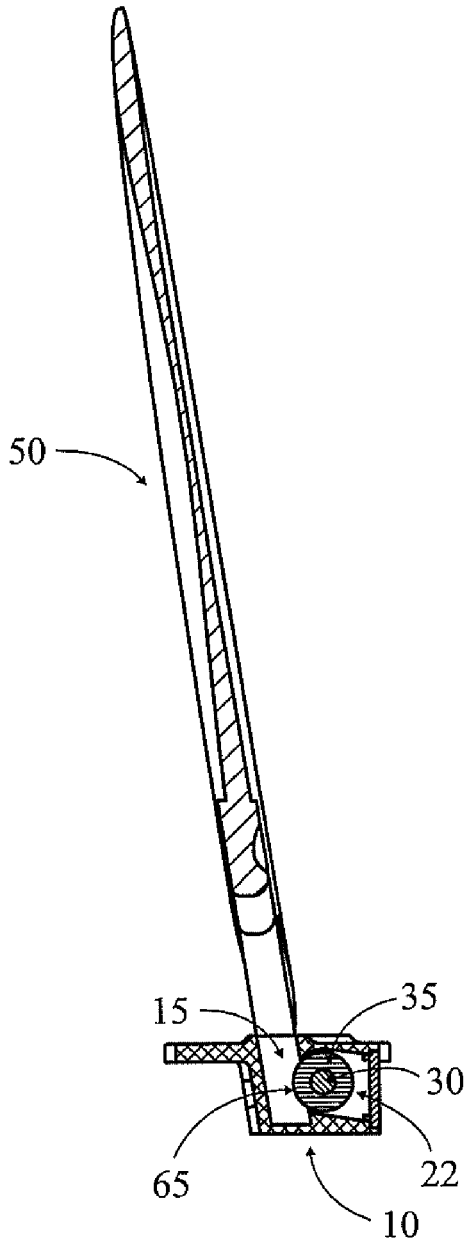
FIG. 5C is a cross-sectional front view of the fin and fin plug assembly of FIG. 5C.
Figure 5D:
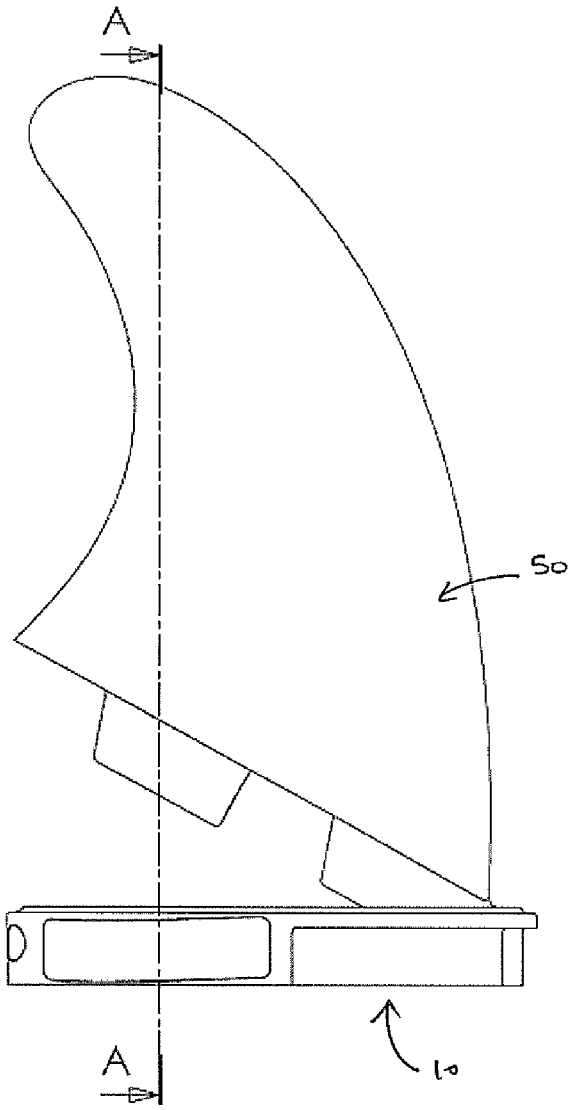
FIG. 5D is a side view of the fin and fin plug assembly of FIG. 5A.
Figure 5E:
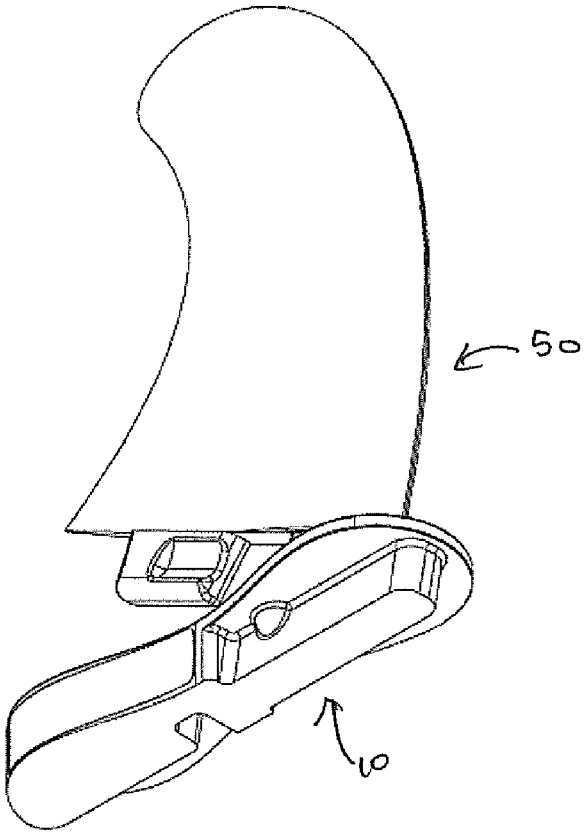
FIG. 5E is a bottom perspective view of the fin and fin plug assembly of FIG. 5A.
Figure 5F:
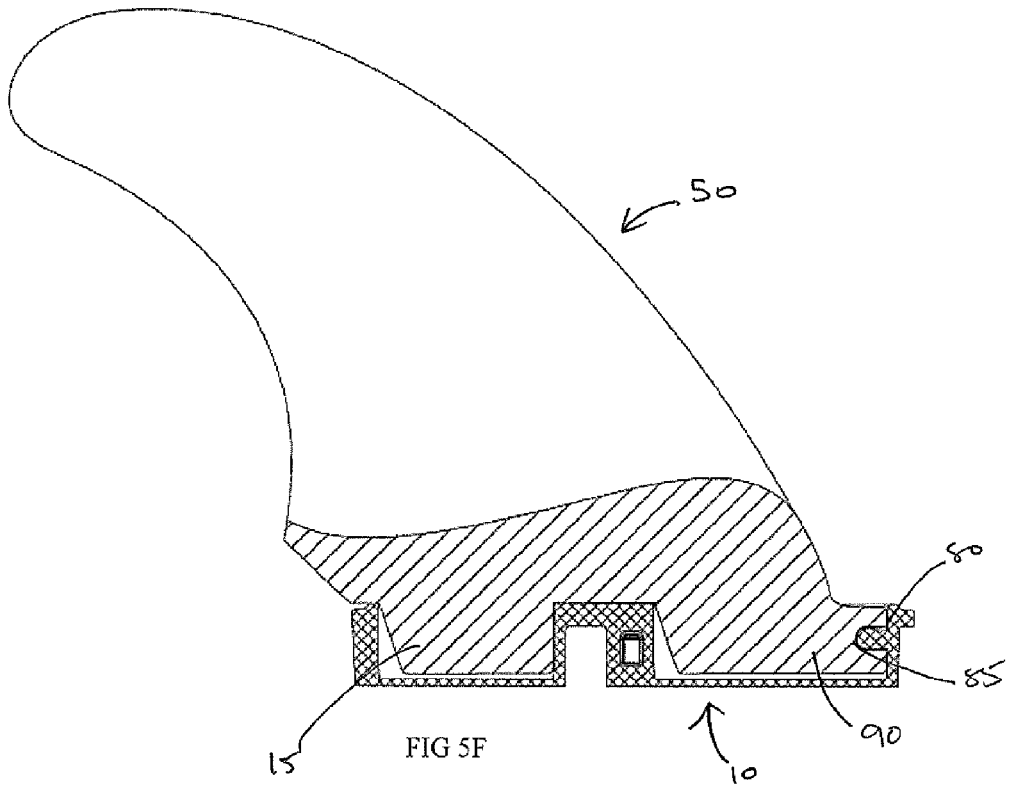
FIG. 5F is a cross-sectional side view of the fin and fin plug assembly of the FIG. 5A, the fin being received by the device.
Figure 5G:
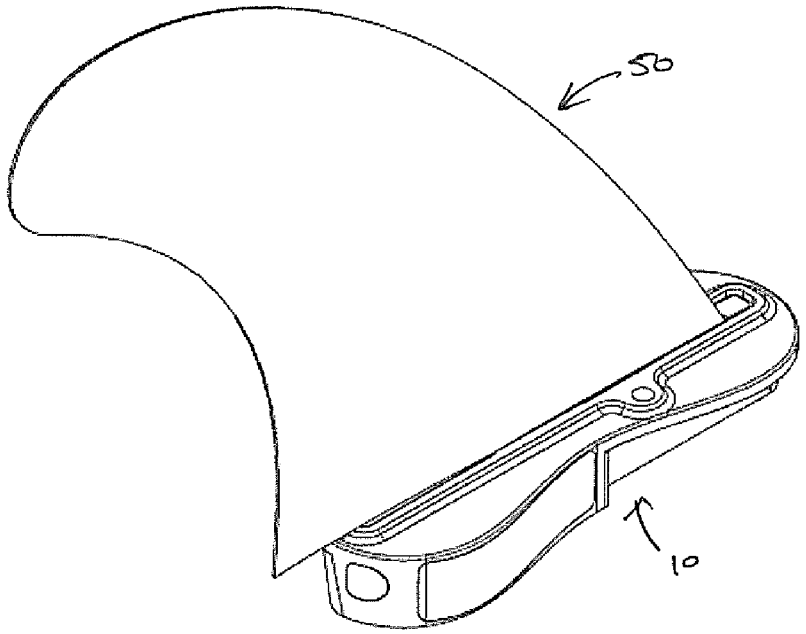
FIG. 5G is a top perspective view of the fin and fin plug assembly of FIG. 5F.

An example of a variation can be seen when comparing FIGS. 2C, 4C, and 5C. In these examples, FIGS. 2A to 3C represent an example of a central fin 50, where, as shown in FIG. 2C, the fin 50 is substantially perpendicular to the device 10. However, in contrast, the fins 50 of FIGS. 4C and 5C, are at an angle to the vertical of the device 10. FIG. 4C is an example of a right-side fin, and FIG. 5C is an example of a left side fin. Although the fins described are configured to be inserted at any angle to the vertical, in one particular example, the angle is 7 to 9 degrees from the vertical.

Accordingly, the device 10 may also be varied to accommodate for the varying angle of insertion. As shown in FIGS. 4C and 5C, the first cavity 15 may include an angled opposing wall 28, opposite to the cavity wall 25 (which is typically cavity wall where the extending portion 35 protrudes there through).

Figure 6A:
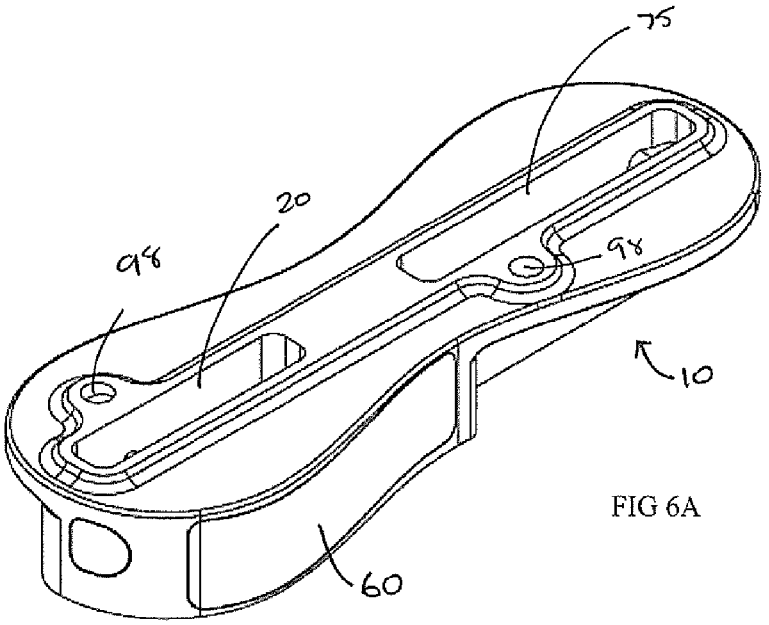
FIG. 6A is a top perspective view of an example device or fin plug.
Figure 6J:
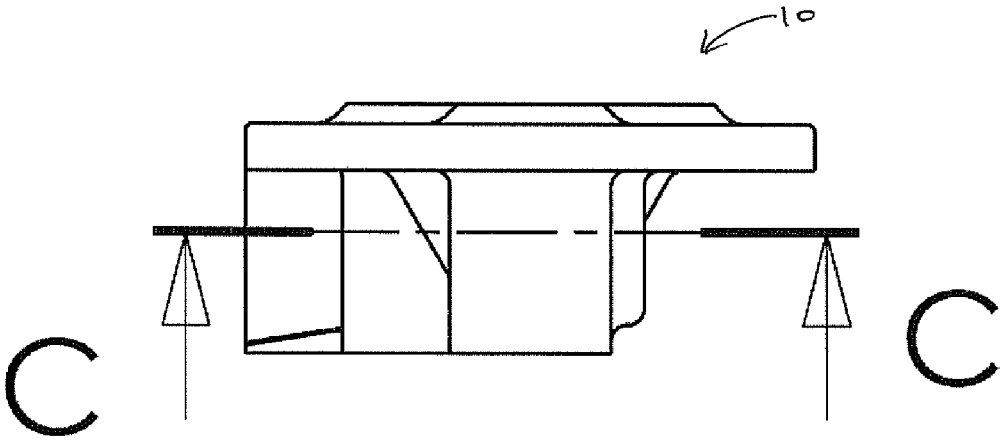
FIG. 6J is a front end elevational view of the device or fin plug of FIG. 6A.
Figure 6I:
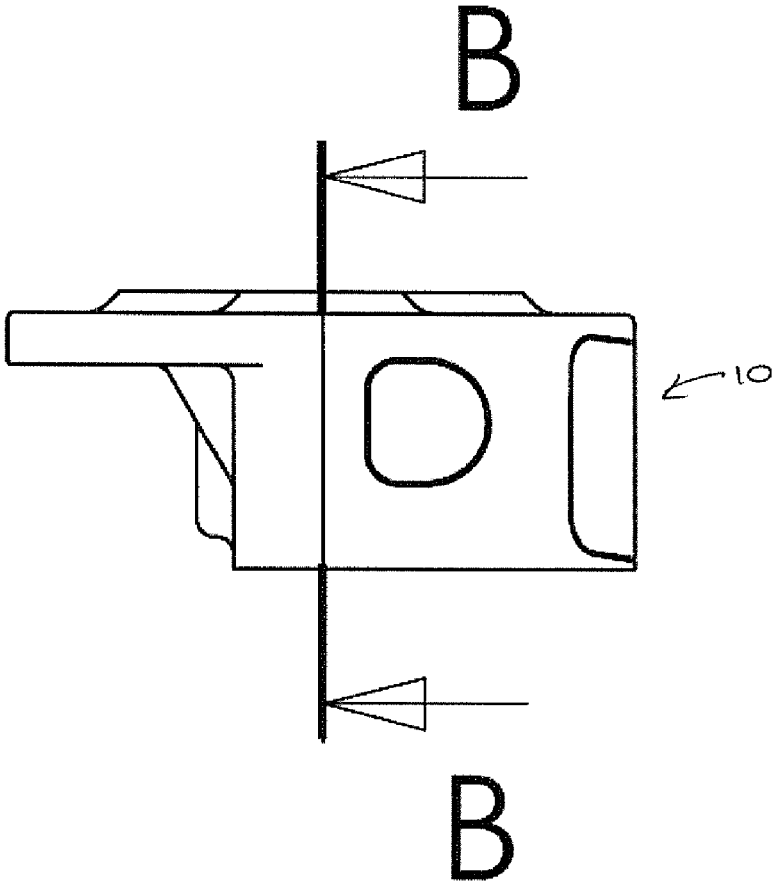
FIG. 6I is a back end elevational view of the device or fin plug of FIG. 6A.
Figure 6B:
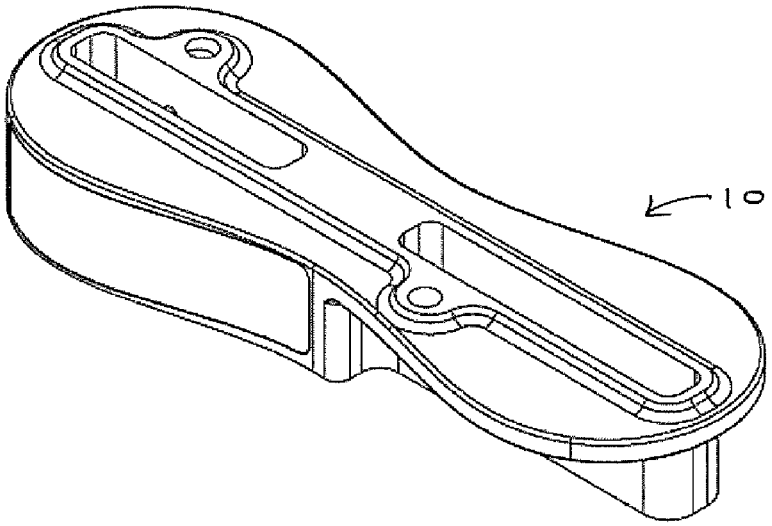
FIG. 6B is another top perspective view of the device or fin plug of FIG. 6A.
Figure 6D:
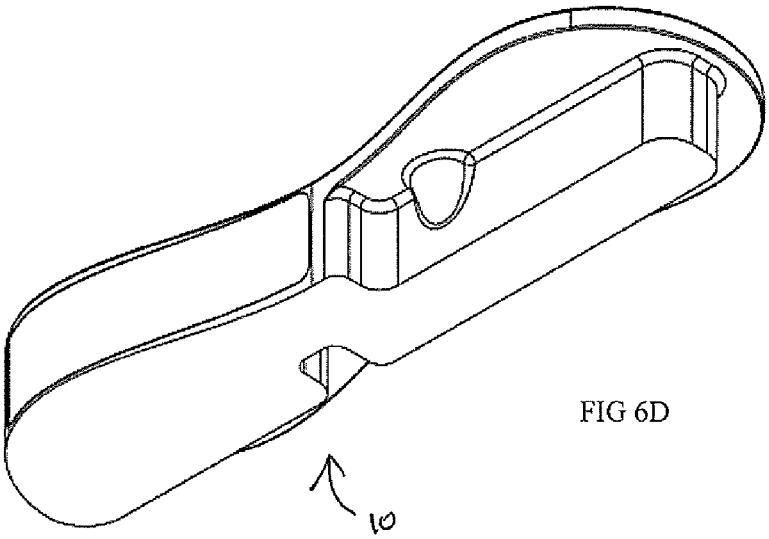
FIG. 6D is another underneath perspective view of the device or fin plug of FIG. 6A.
Figure 6C:
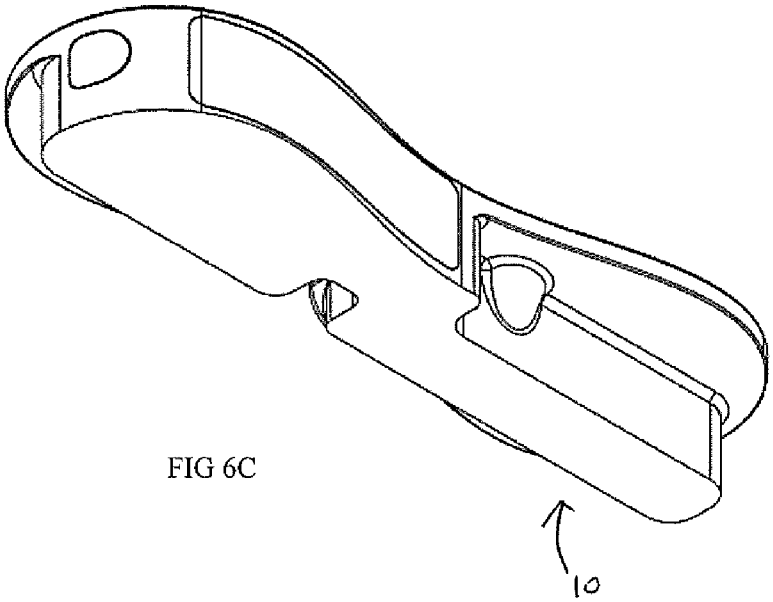
FIG. 6C is an underneath perspective view of the device or fin plug of FIG. 6A.
Figure 6F:
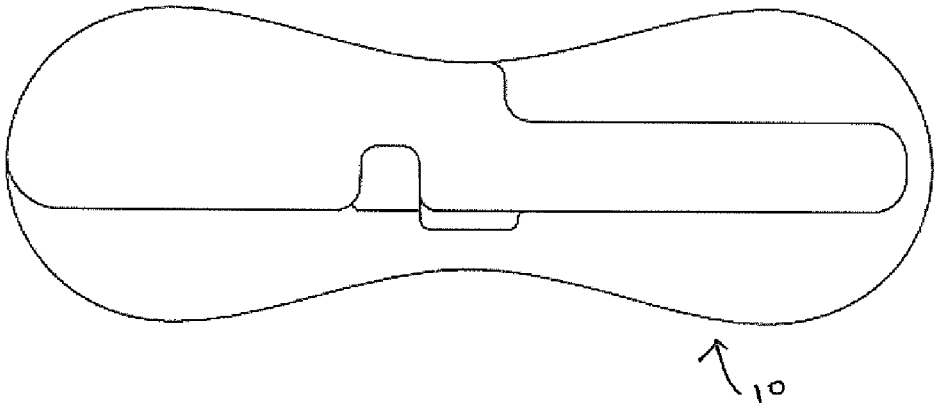
FIG. 6F is an underneath elevational view of the device or fin plug of FIG. 6A.
Figure 6E:
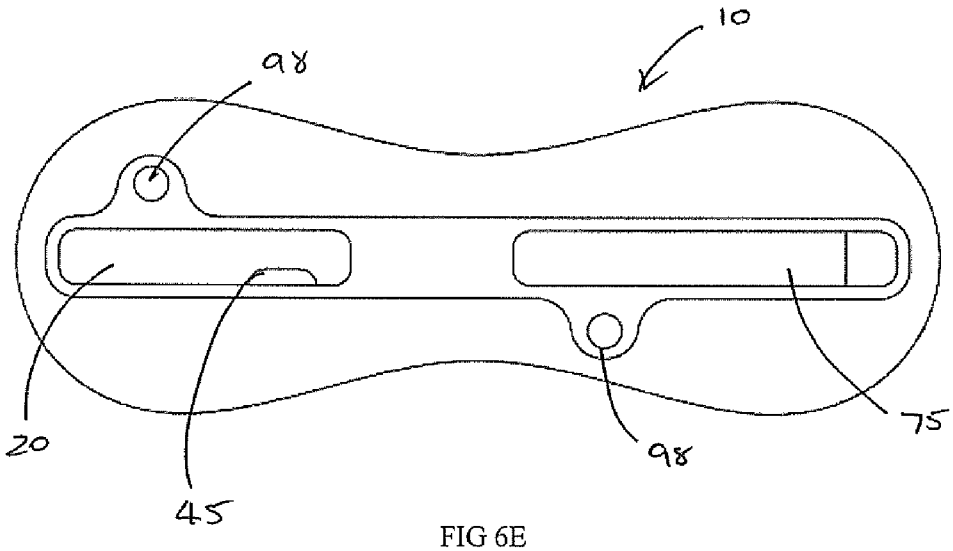
FIG. 6E is a top elevational view of the device or fin plug of FIG. 6A.
Figure 6G:
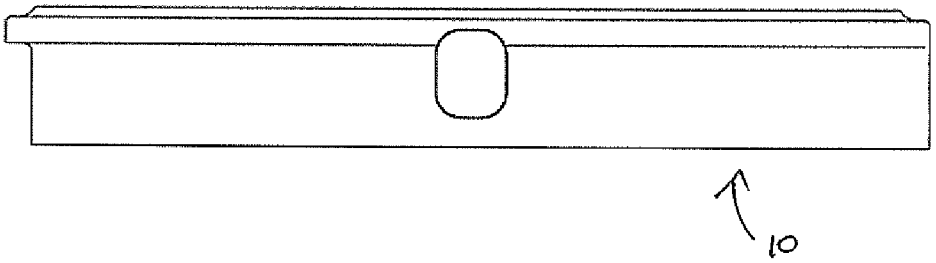
FIG. 6G is a side elevational view of the device or fin plug of FIG. 6A.
Figure 6H:
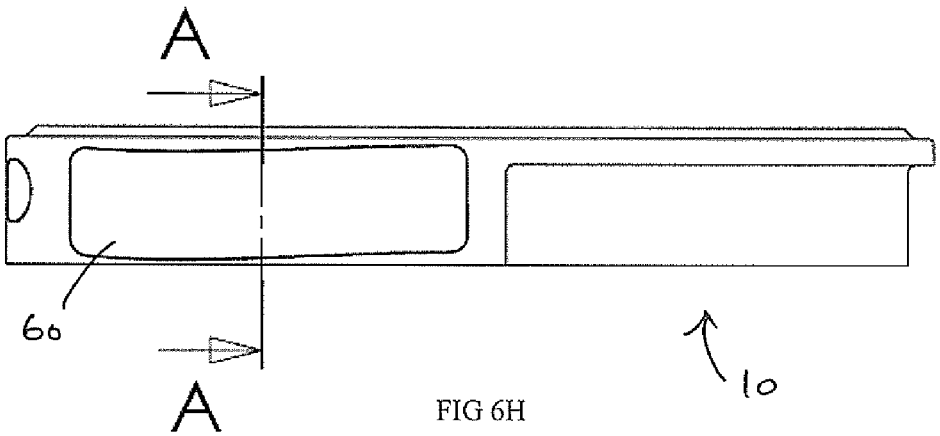
FIG. 6H is another side elevational view of the device or fin plug of FIG. 6A.
Figure 6L:
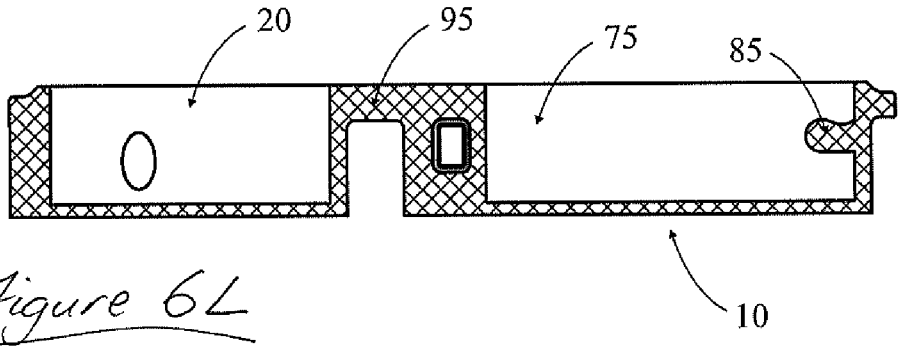
FIG. 6L is a cross-sectional view of the device or fin plug of FIG. 6I along the section line B-B.
Figure 6K:
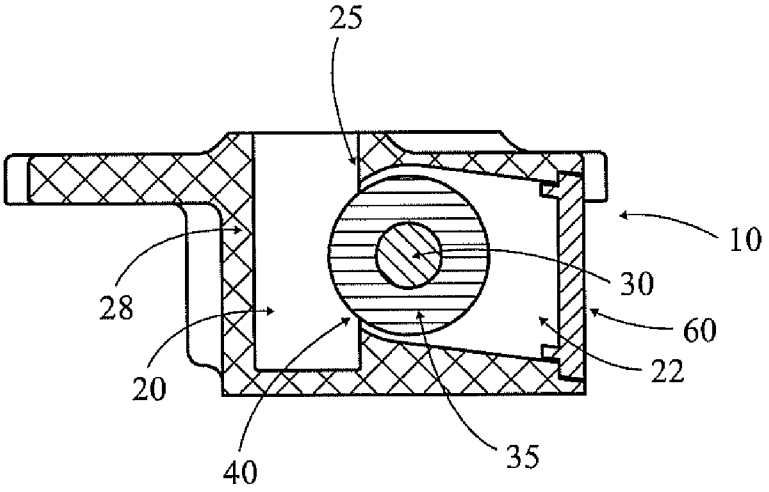
FIG. 6K is a cross-sectional view of the device or fin plug of FIG. 6H along the section line A-A.
Figure 6M:
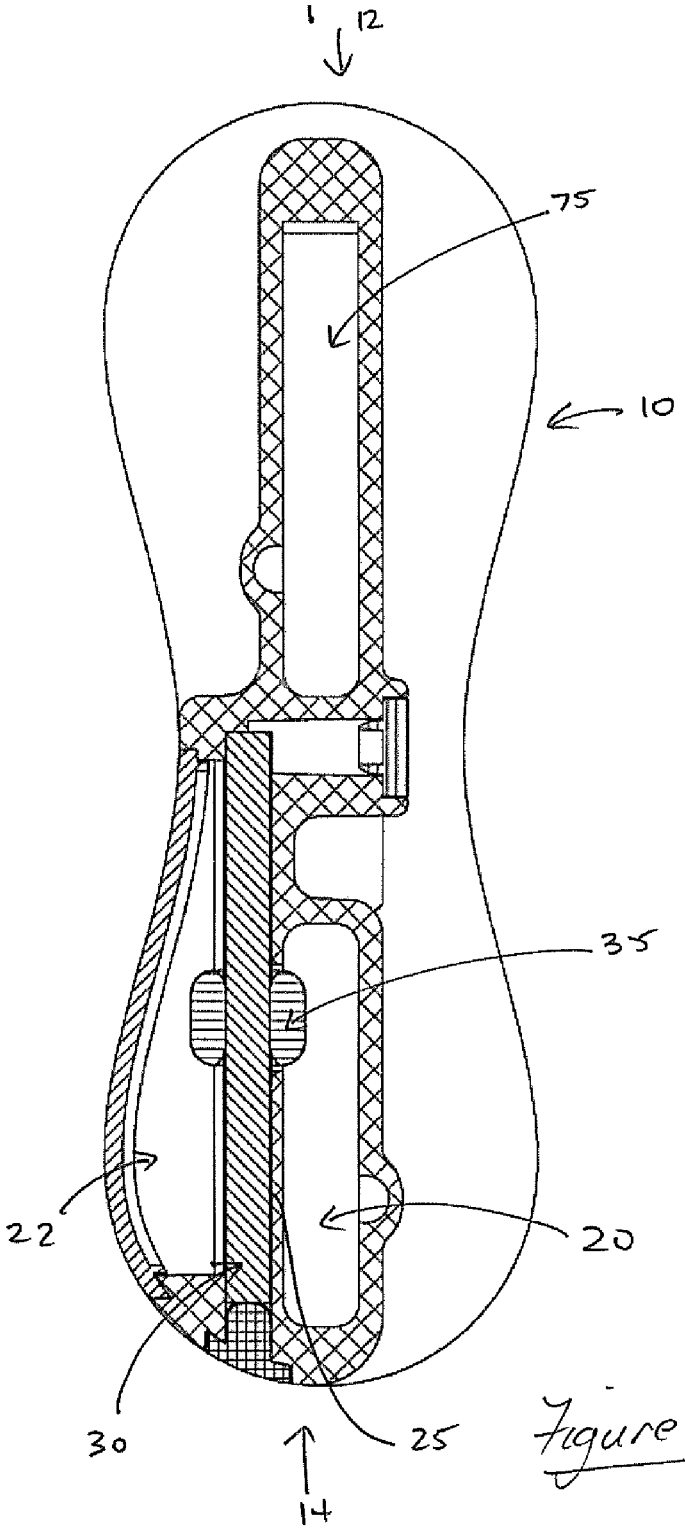
FIG. 6M is a cross-sectional view of the device or fin plug of FIG. 6K along the section line C-C.
Figure 6N:
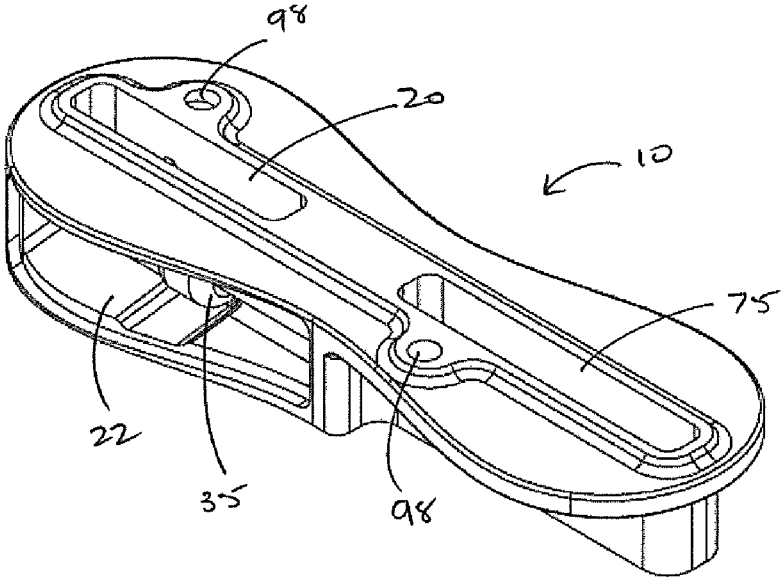
FIG. 6N is a top perspective view of the device or fin plug of FIG. 6A without a cap 60.
Figure 6O:
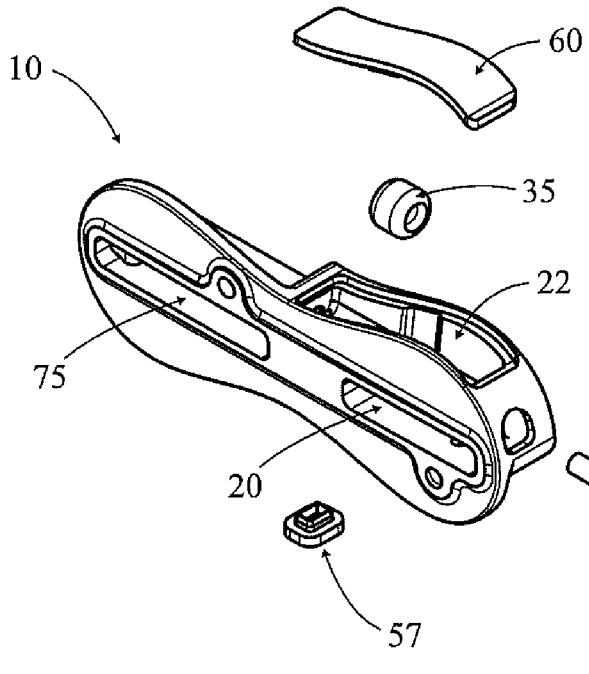
FIG. 6O is an exploded view of the device or fin plug of FIG. 6A.
Figure 6P:
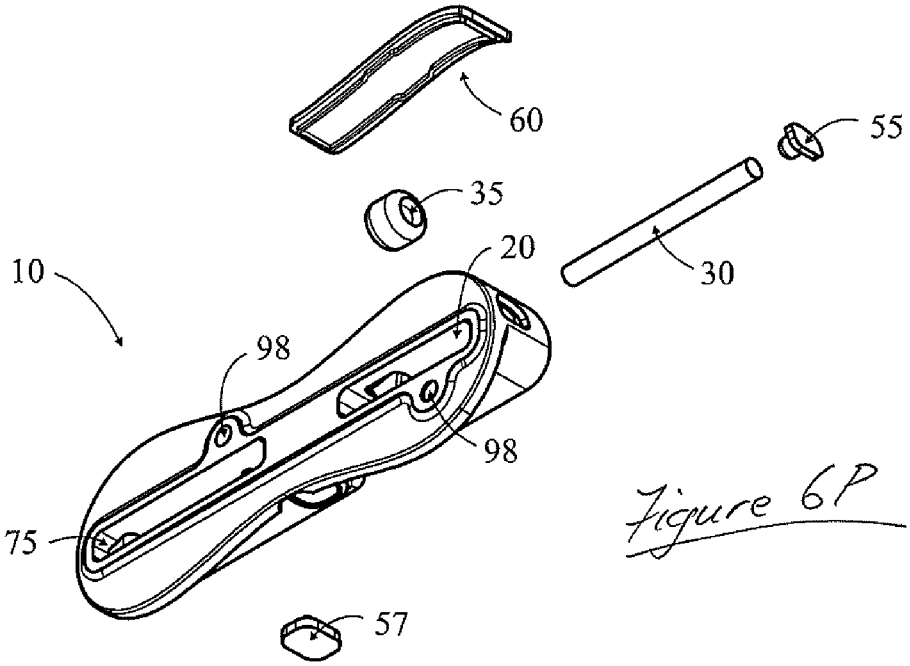
FIG. 6P is another exploded view of the device or fin plug of FIG. 6A.

In further examples, FIGS. 6A to 6P show example of a device or fin plug 10, where in these examples, the device 10 would typically be used for a centre fin. It will be appreciated by persons skilled in the art that, as shown in FIG. 6N, the extending portion 35 protrudes through the cavity wall 25 at a position where it can easily mate with the corresponding grooved portion 65 of the fin 50. Thus, the extending portion 35 need not necessarily protrude through at the centre of the cavity wall 25, and can, according to this particular example, be offset from the centre.

Additionally, the device 10 shows fixation points 98 for fixing of grub screws or any other suitable fixing means, or the like, for further fixing the fin 50 to the device 10. It will be appreciated that the use of the grub screws or other suitable fixing means can allow for different types of fins to be fixed to the device 10. Thus in this particular example, the grub screw can be configured to extend into the first cavity 20 to further secure a base portion of the fin 50 within the first cavity 20. A similar grub screw can be used for the second cavity 75 where a grub screw is configured to extend into the second cavity 75 to further secure a tab, base portion, or the like of the fin 50 into the second cavity 75.

Figure 7A:
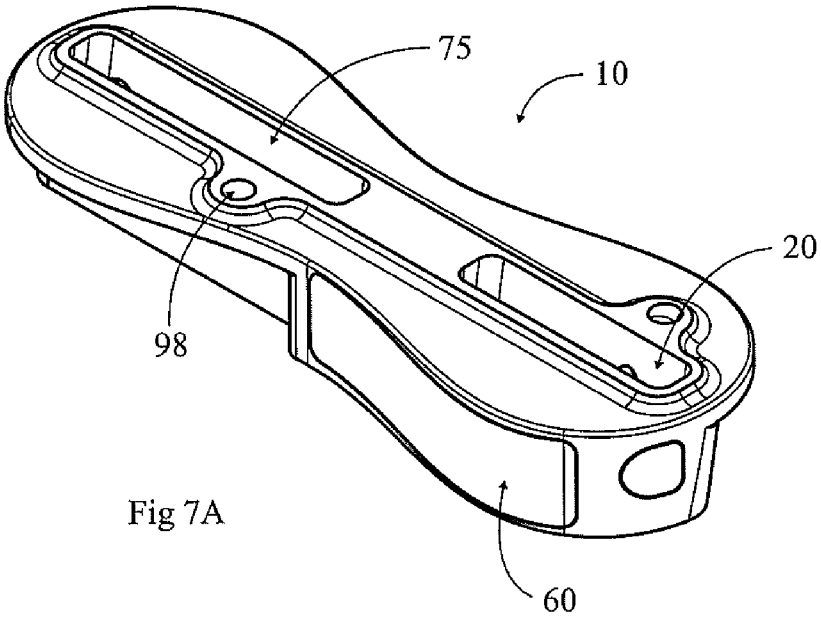
FIG. 7A is a top perspective view of an example right-side device or fin plug.
Figure 7B:
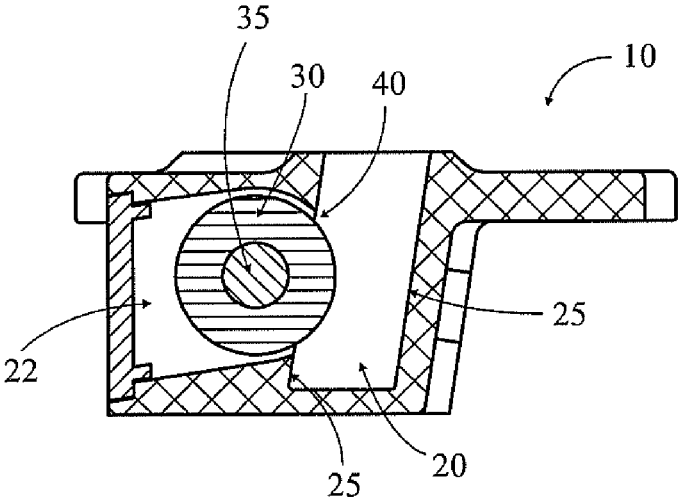
FIG. 7B is front cross-sectional view of the device or fin plug of FIG. 7A.
Figure 7C:
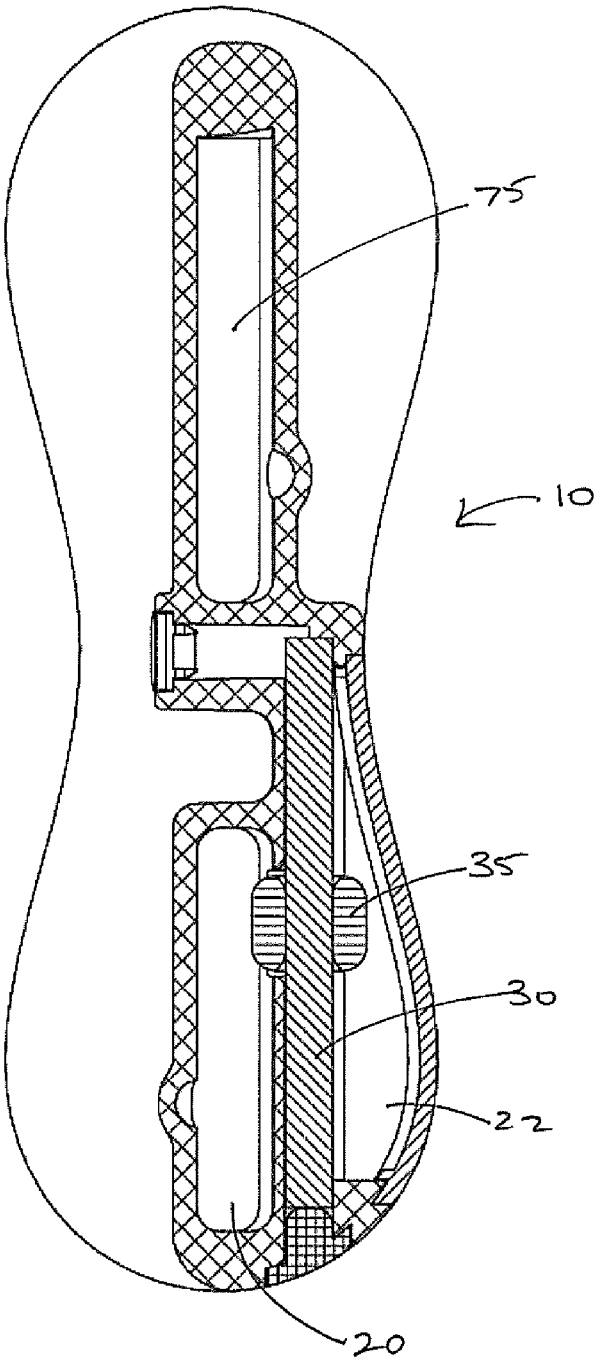
FIG. 7C is a top cross-sectional view of the device or fin plug of FIG. 7A.
Figure 7D:
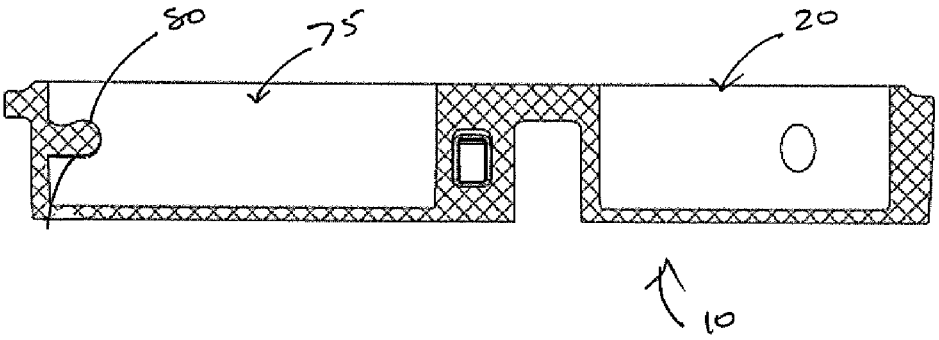
FIG. 7D is a side cross-sectional view of the device or fin plug of FIG. 7A.
Figure 8A:
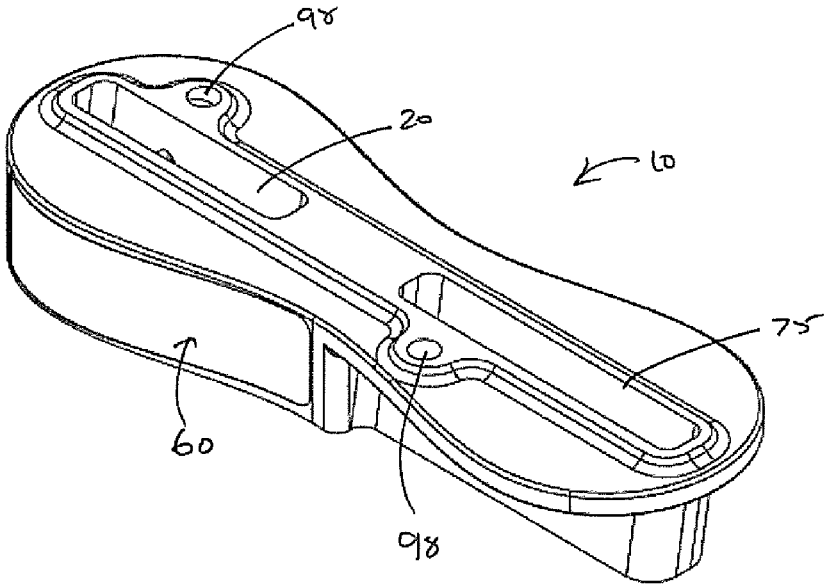
FIG. 8A is a top perspective view of an example left-side device or fin plug.
Figure 8D:
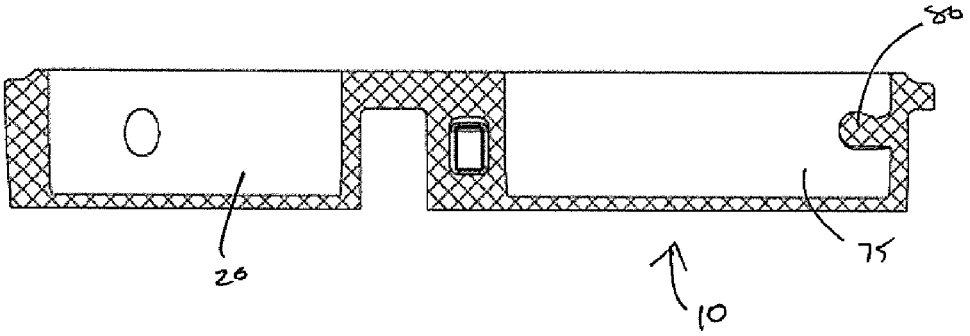
FIG. 8D is a side cross-sectional view of the device or fin plug of FIG. 8A.
Figure 8B:
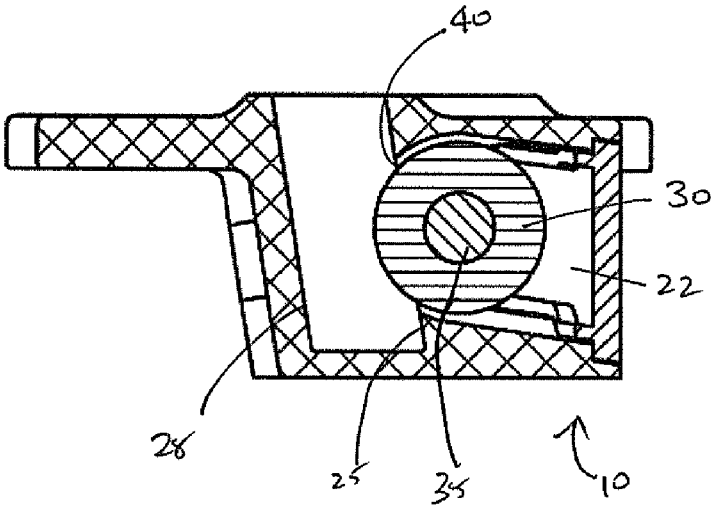
FIG. 8B is front cross-sectional view of the device or fin plug of FIG. 8A.
Figure 8C:
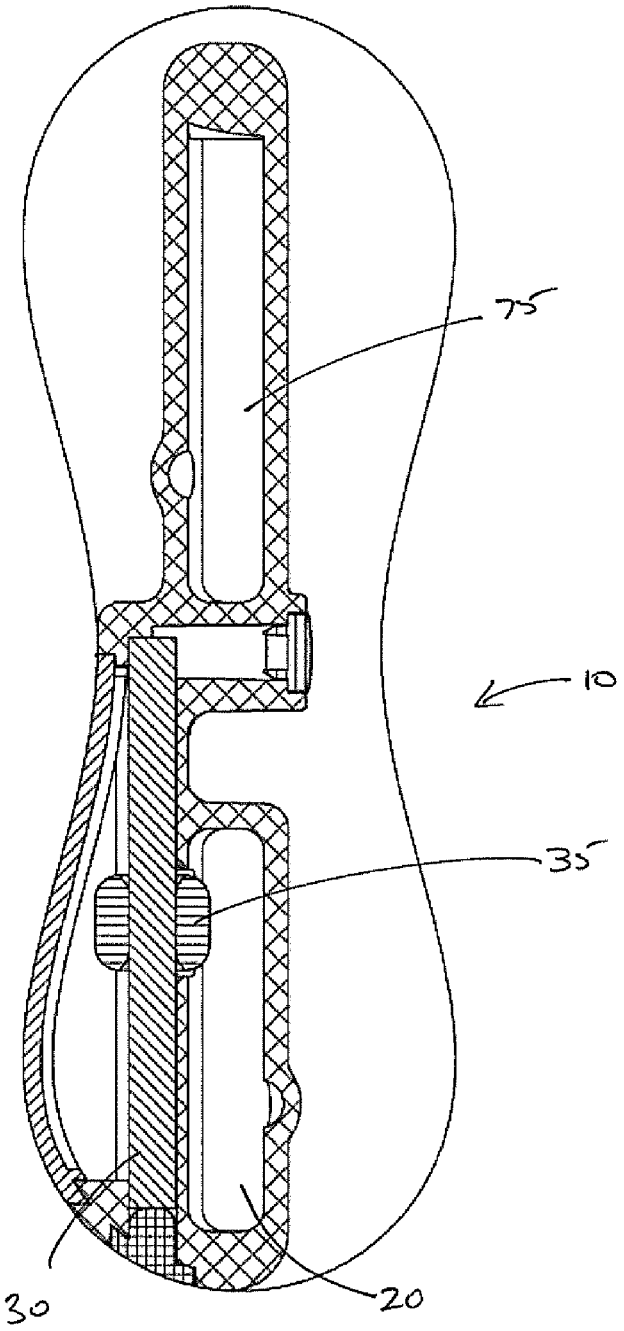
FIG. 8C is a top cross-sectional view of the device or fin plug of FIG. 8A.
Figure 9A:
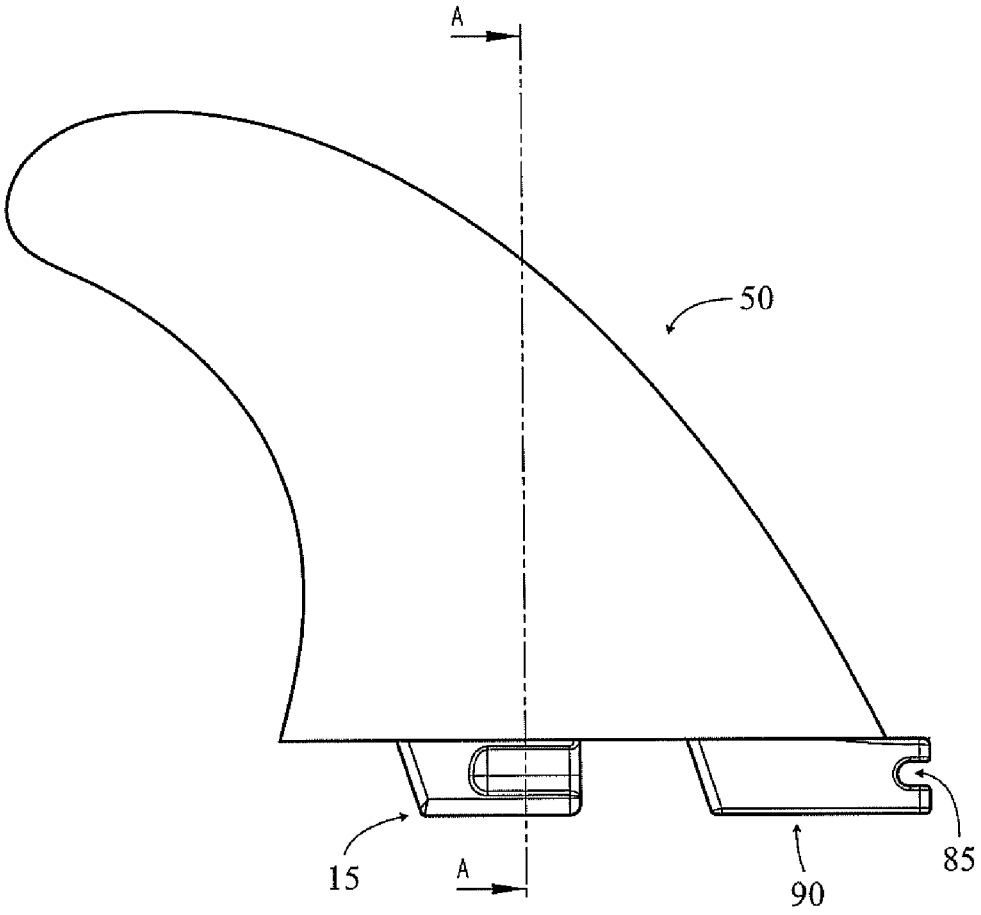
FIG. 9A is a side view of an example fin, which can be used with a device or fin plug described herein.
Figure 9B:
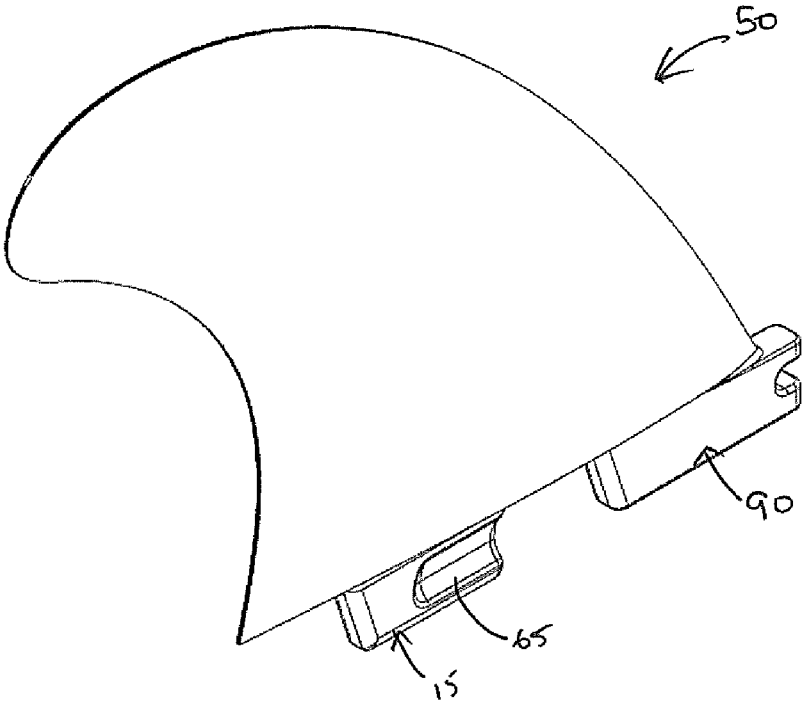
FIG. 9B is a top perspective view of the fin of FIG. 9A.
Figure 9C:
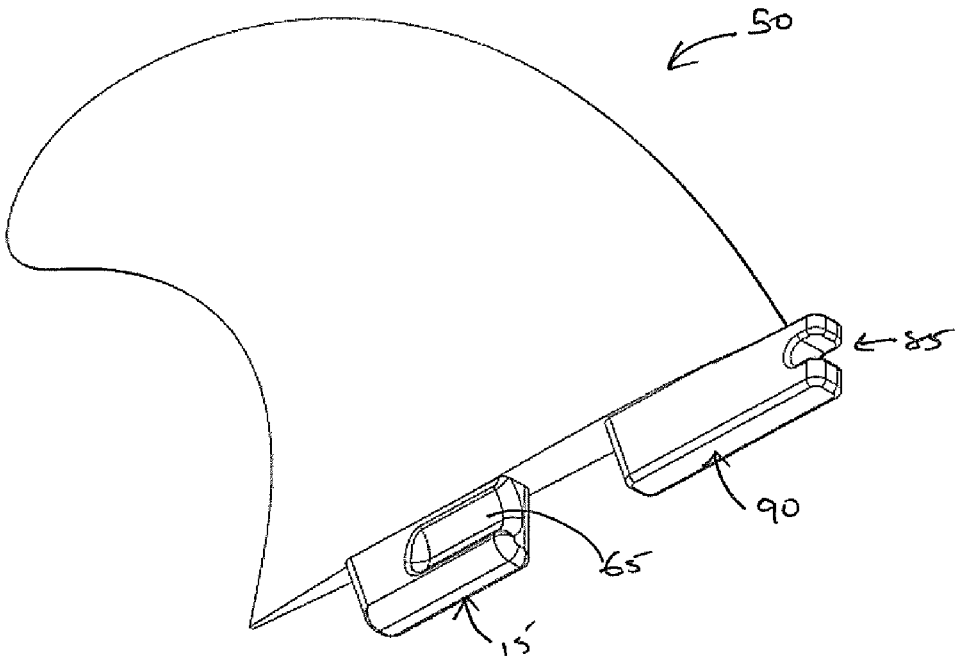
FIG. 9C is a bottom perspective view of the fin of FIG. 9A.
Figure 9D:
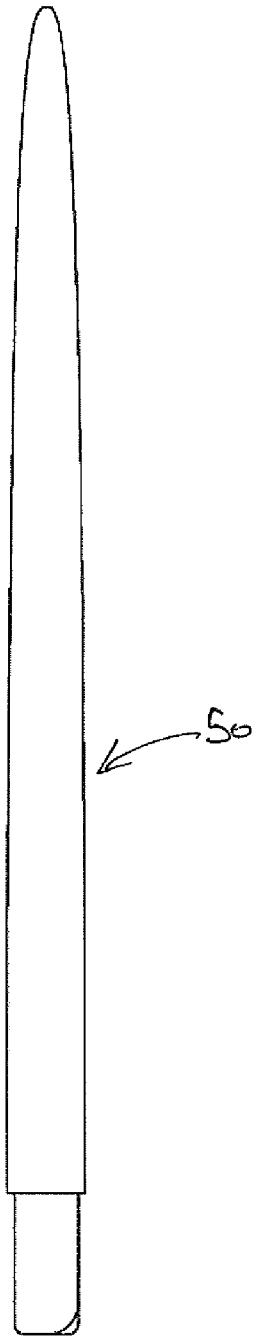
FIG. 9D is a front view of the fin of FIG. 9A.
Figure 9E:
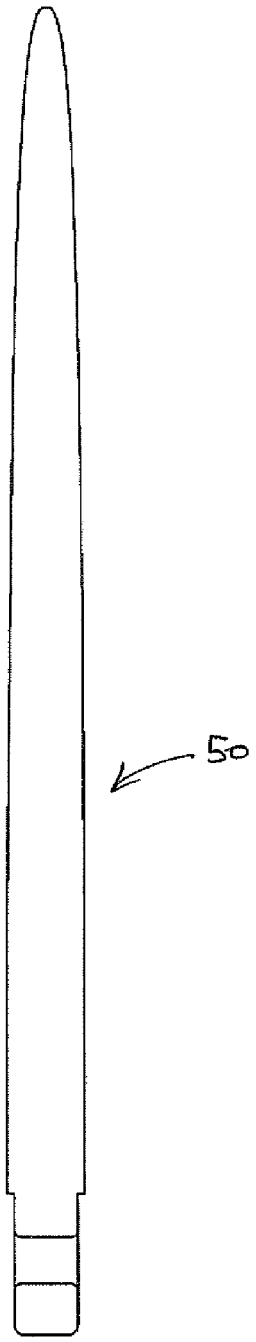
FIG. 9E is a back view of the fin of FIG. 9A.
Figure 9F:
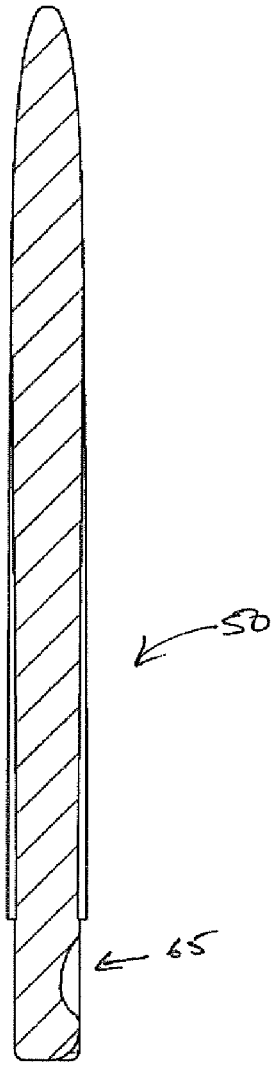
FIG. 9F is a cross-sectional view of the fin of FIG. 9A.
Figure 9G:
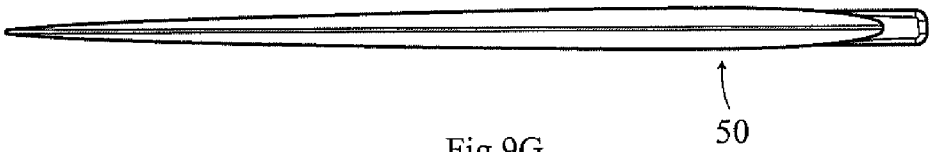
FIG. 9G is a top view of the fin of FIG. 9A.
Figure 9H:
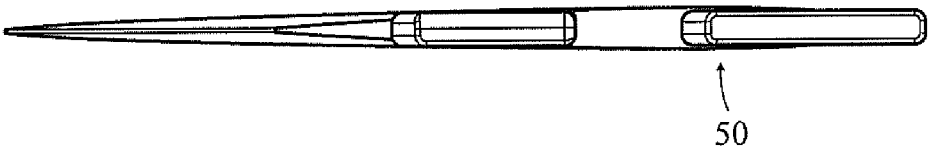
FIG. 9H is a bottom view of the fin of FIG. 9A.
Figure 10A:
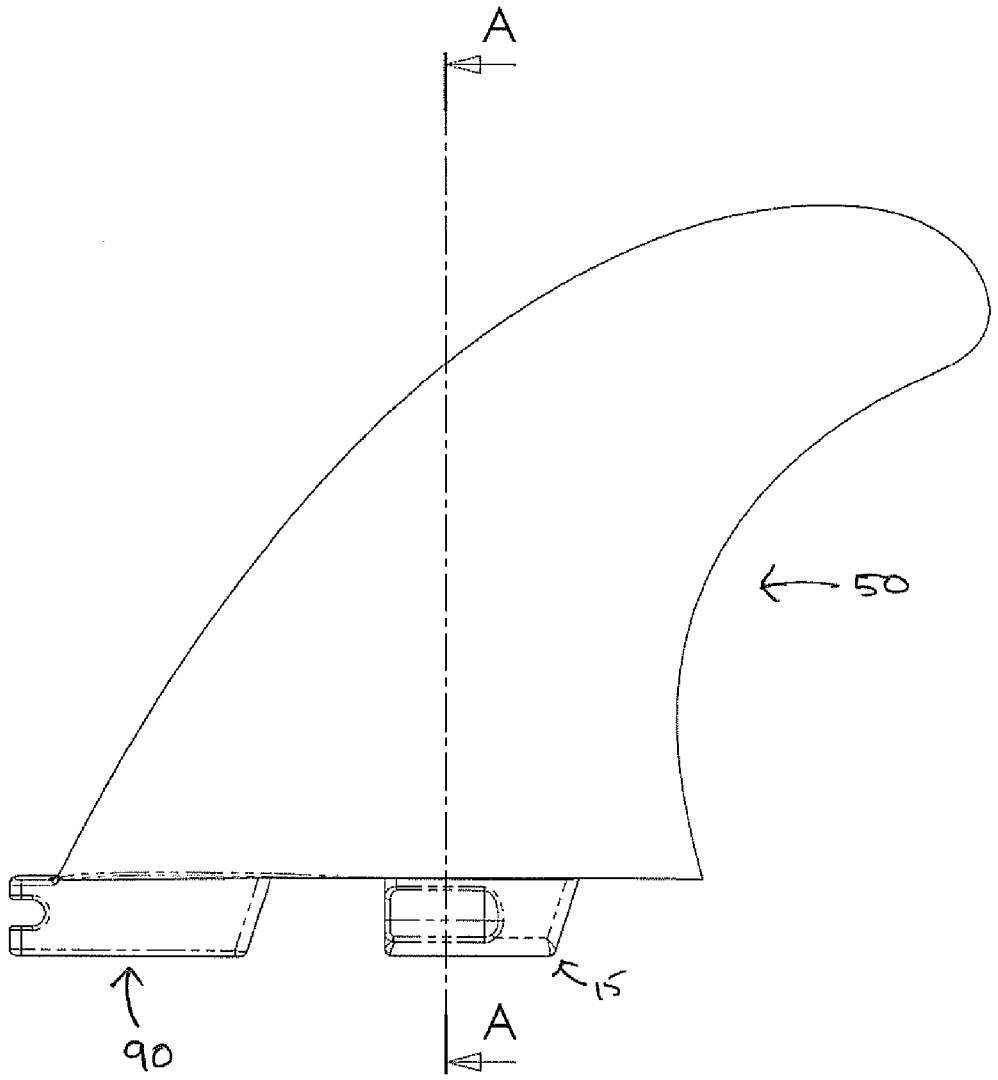
FIG. 10A is a side view of an example right-side fin, which can be used with a device or fin plug described herein.
Figure 10B:
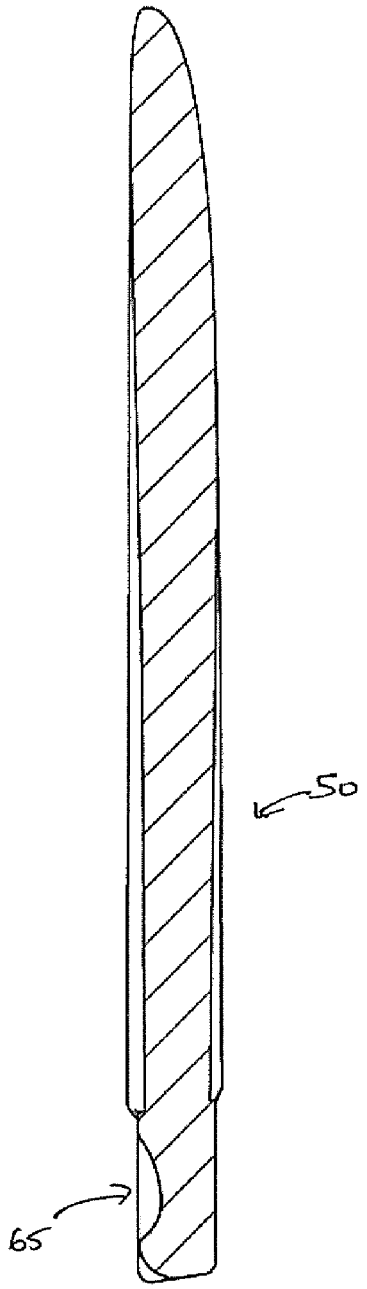
FIG. 10B is a cross-sectional view of the fin of FIG. 10A.
Figure 10C:
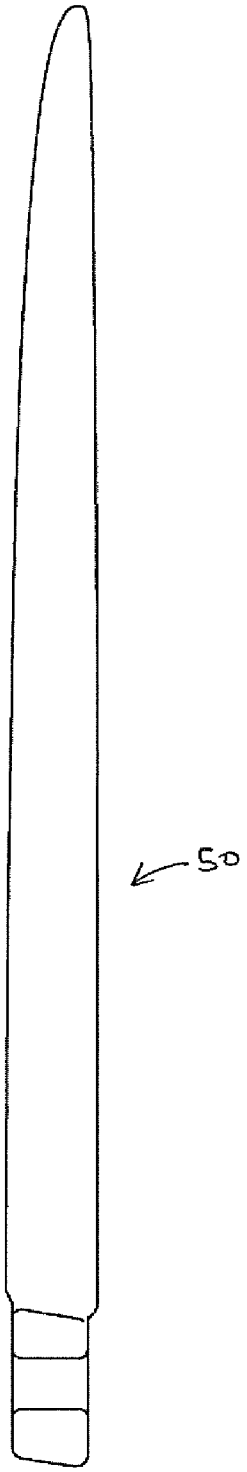
FIG. 10C is a back view of the fin of FIG. 10A.
Figure 10D:
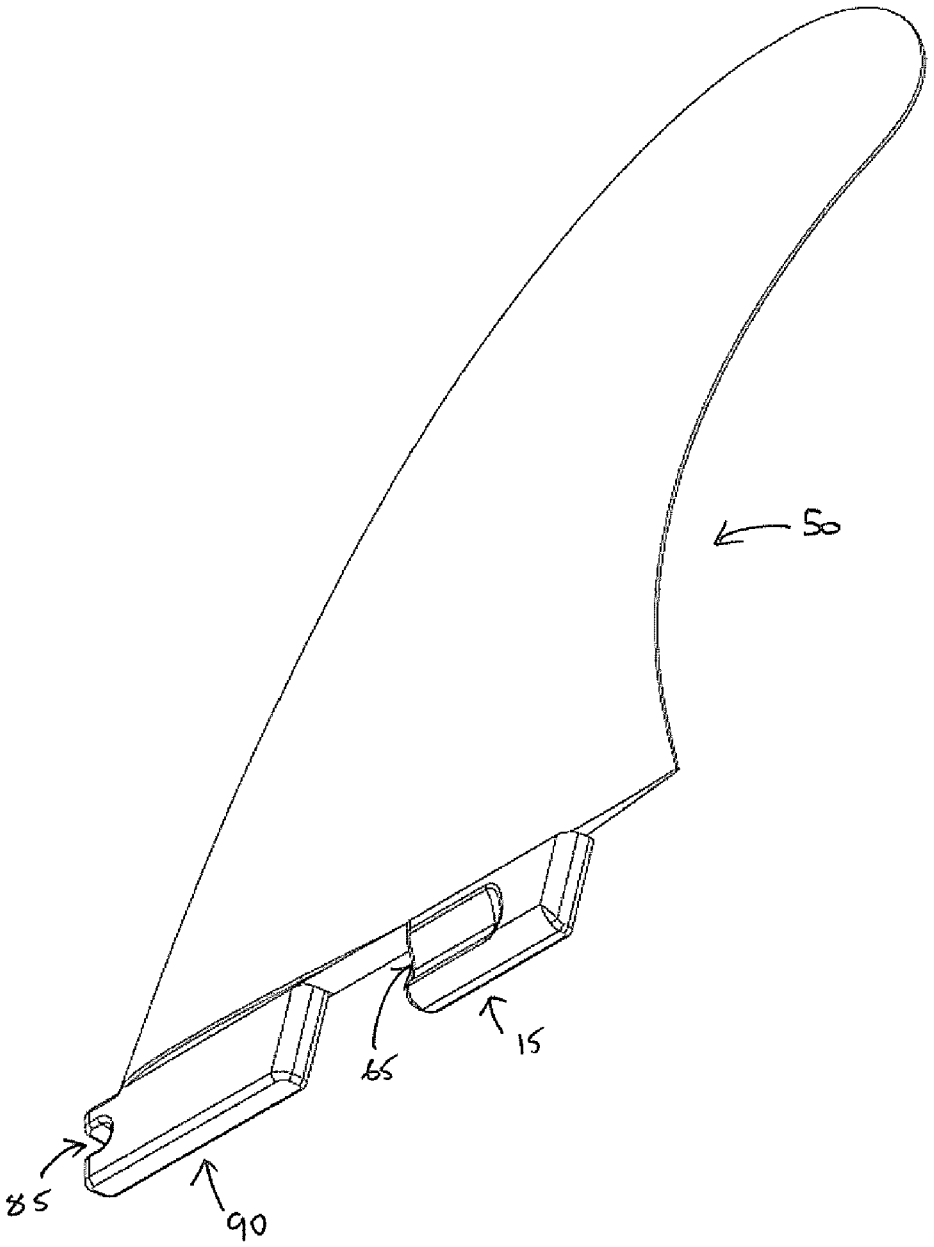
FIG. 10D is a top perspective view of the fin of FIG. 10A.
Figure 11A:
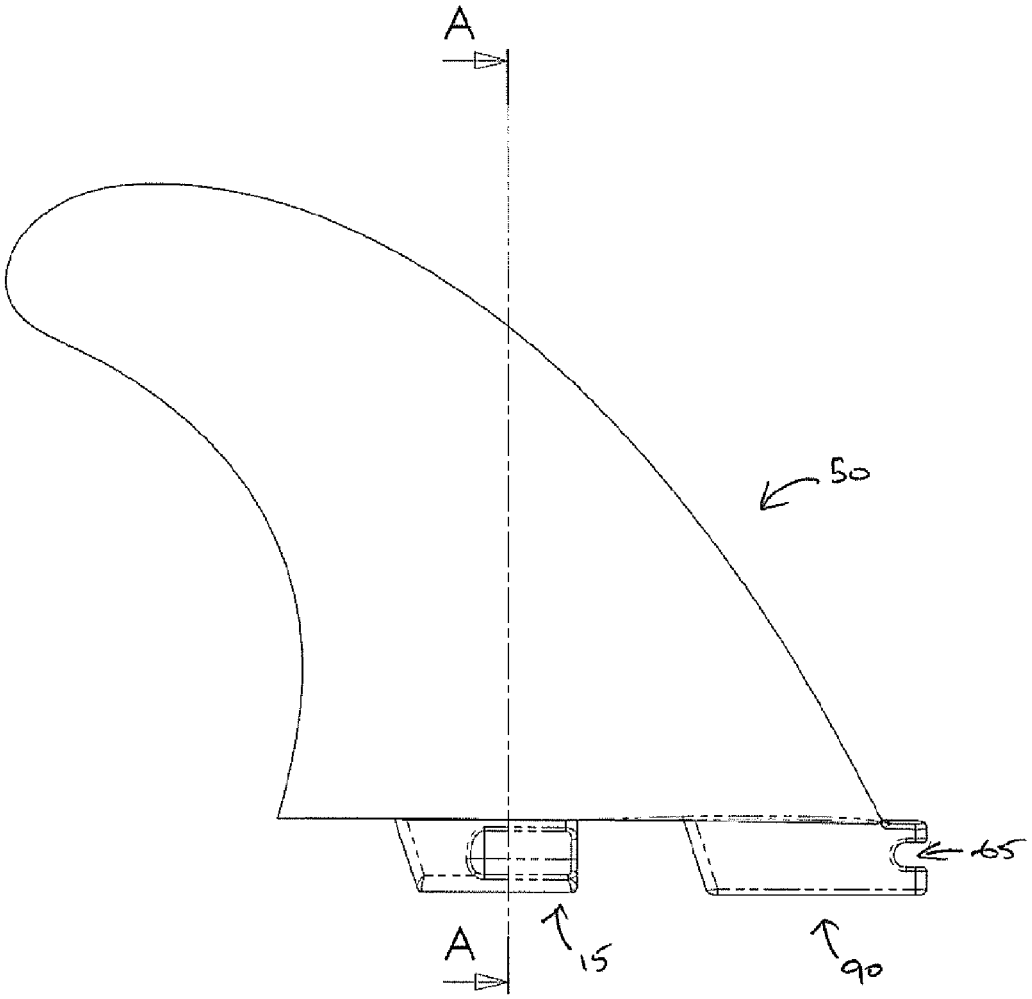
FIG. 11A is a side view of an example left-side fin, which can be used with a device or fin plug described herein.
Figure 11B:
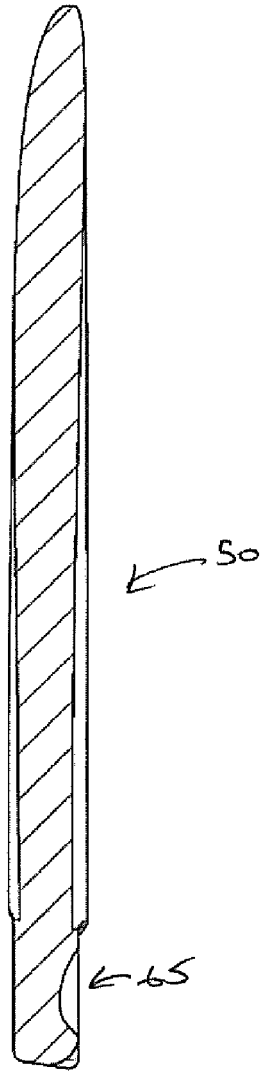
FIG. 11B is a cross-sectional view of the fin of FIG. 11A.
Figure 11C:
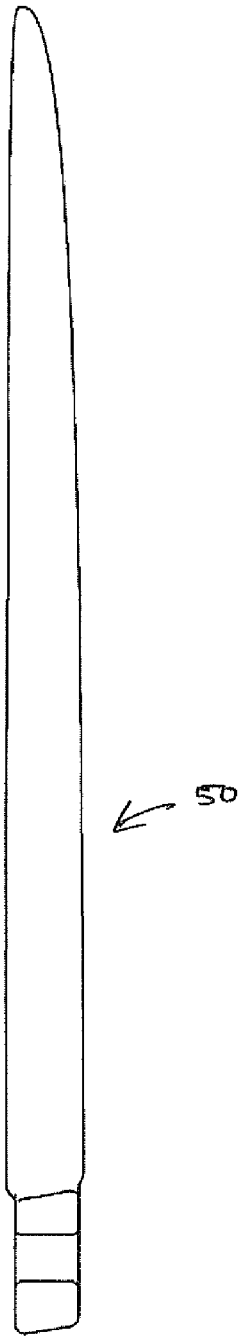
FIG. 11C is a back view of the fin of FIG. 11A.
Figure 11D:
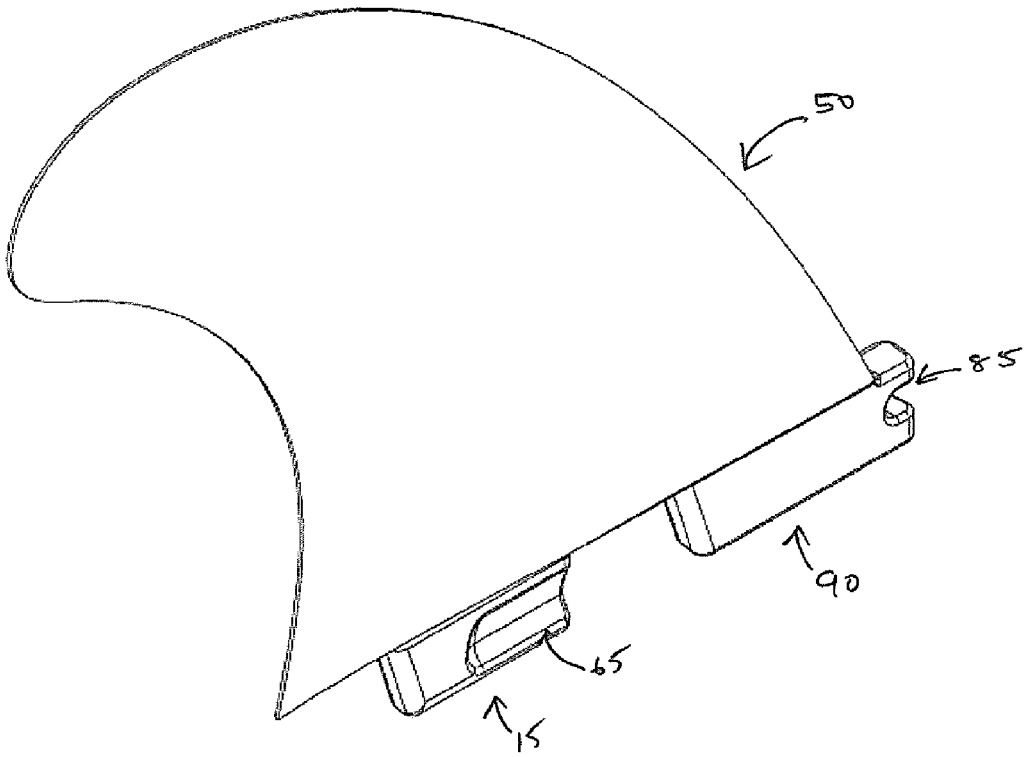
FIG. 11D is a top perspective view of the fin of FIG. 11A.

FIGS. 7A to 7D are examples of the device 10 for use with a right side fin. Furthermore, FIGS. 8A to 8D are examples of the device 10 for use with a left side fin. Of particular note from these figures, it will be appreciated that the examples show that the devices when used for the side fins (such as the left and right fins) can be formed such that they are mirror images of each other. Furthermore, FIGS. 7B and 8B show the angled opposing wall 28, to allow for an angled insertion of the respective fins.

In the examples shown herein, the device 10 is shaped substantially as a figure-eight, such that at least one profile of the device has substantially, a figure-eight shape. In these examples, the first cavity 15 is located or formed within a first end 12 of the figure-eight and the second cavity 75 is formed within the second end 14 of the figure-eight.

It will be appreciated by persons skilled in the art that the figure-eight shape of the device 10 can provide advantages such allowing for the device 10 to form part of the water craft and further allowing the fin portions to be locked therein. The smooth edges of the figure-eight shape can also provide for an easier manufacturing process. However, it will be appreciated that the device is not limited to this shape and other shapes which provide the functionality of the cavities, are incorporated herein.

FIGS. 9A to 9H show examples of a centre fin 50, for use with a centre device 10. FIGS. 10A to 10D show examples of a right fin 50, and FIGS. 11A to 11D show an example of a left fin 50. Notably, the left and right fins may be mirror images of each other.

Notably, referring to the fins 50, it will further be appreciated that although the first fin portion 15 and the second fin portion 90 can be or can include first and second tabs respectively, it will be appreciated that any base portion of the fin 50 may be configured to be insertable into the first and second cavities 20, 75.

Further variants of the securing fin plug arrangement are disclosed in WO 2014/008529, the contents of which are incorporated by reference.

FIGS. 12A to 15D, and FIGS. 16A to 16C, illustrate two different embodiments of securing mechanism being incorporated in a fin of the water craft.

In FIGS. 12A to 15D, the securing mechanism is formed in a cartridge 4000, or cassette, which is installed in the base portion 4018 of a fin 4050.

Figure 12A:
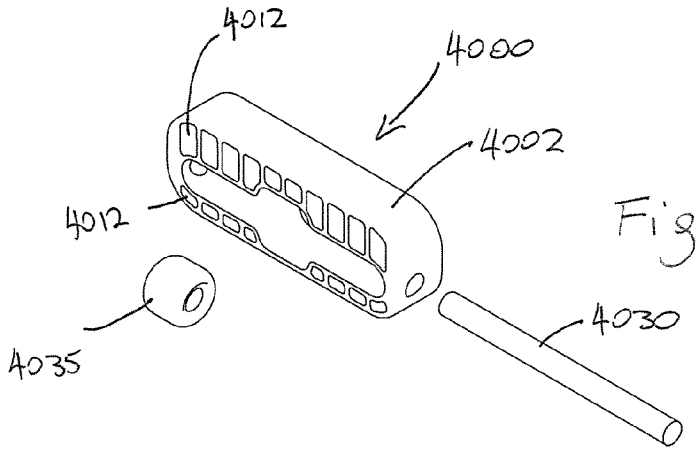
Figure 12B:
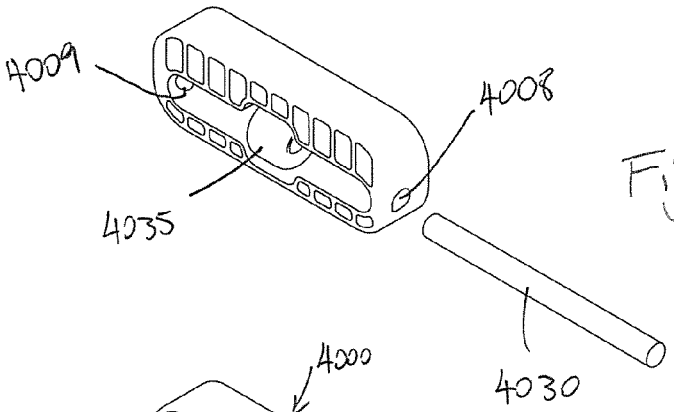
Figure 12C:
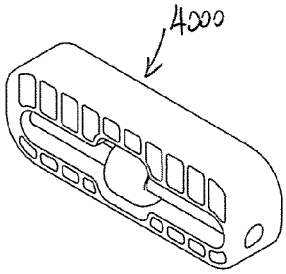

The cartridge is illustrated in FIGS. 12A to 12C in sequence of assembly.

Cartridge 4000 consists of an outer cartridge body 4002 which provides a support framework for the resilient biasing rod 4030 and wheel-like protruding member 4035, which when assembled sit within a side-opening cavity 4004 of the cartridge, the cavity having a wider central portion 4006 to accommodate the member 4030.

At the ends of the cavity are end holes 4008 and 4009 which act to support the ends of the biasing rod, with one of the end holes 4008 being a through hole to allow insertion of the rod during cartridge assembly. The other end hole 4009 may be either a through hole or a blind hole.

Figure 13A:
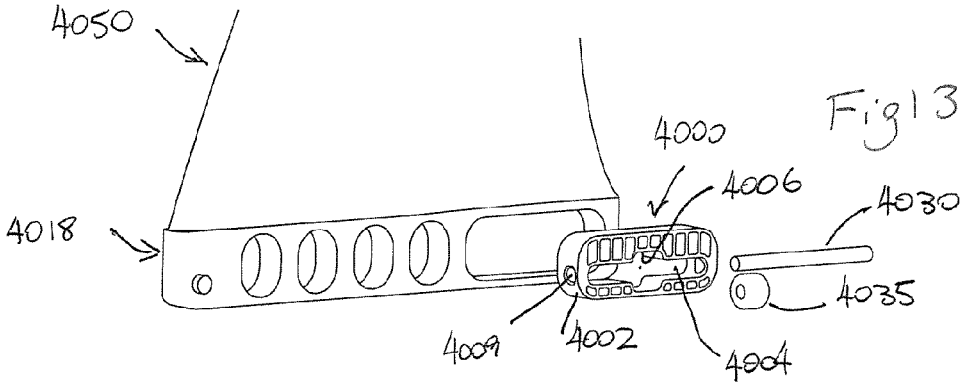
FIGS. 13A to 13D is a series of views showing the cartridge being installed into the base portion of a fin.
Figure 13B:
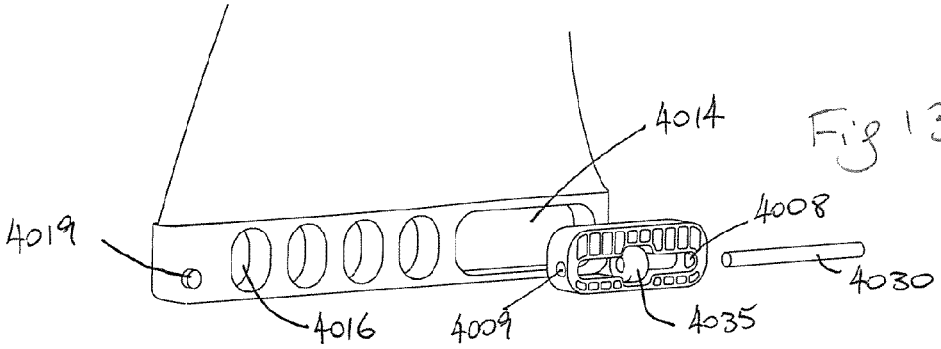
Figure 13C:
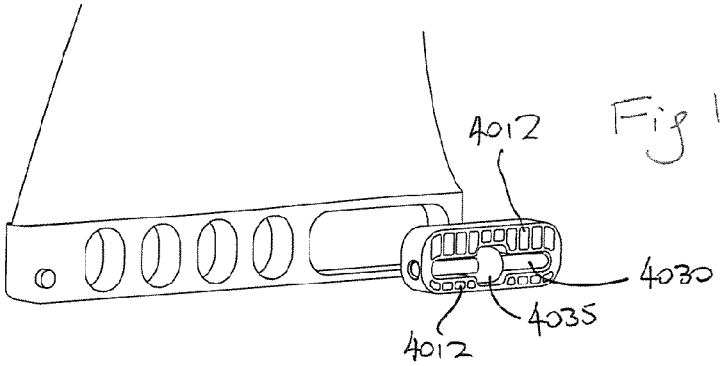
Figure 13D:
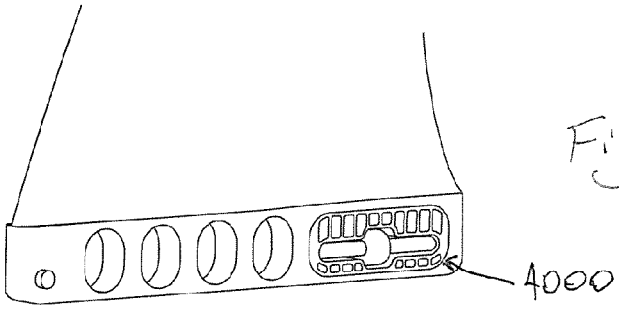
Figure 14A:
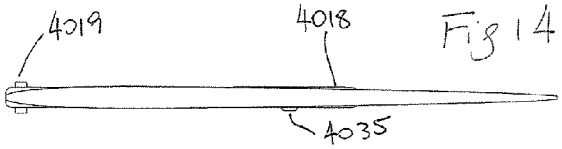
FIGS. 14A to 14E are orthogonal views and an elevational section view of a fin incorporating the cartridge.
Figure 14B:
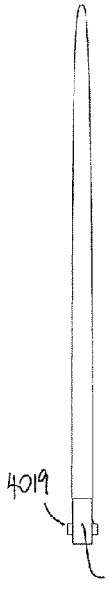
Figure 14C:
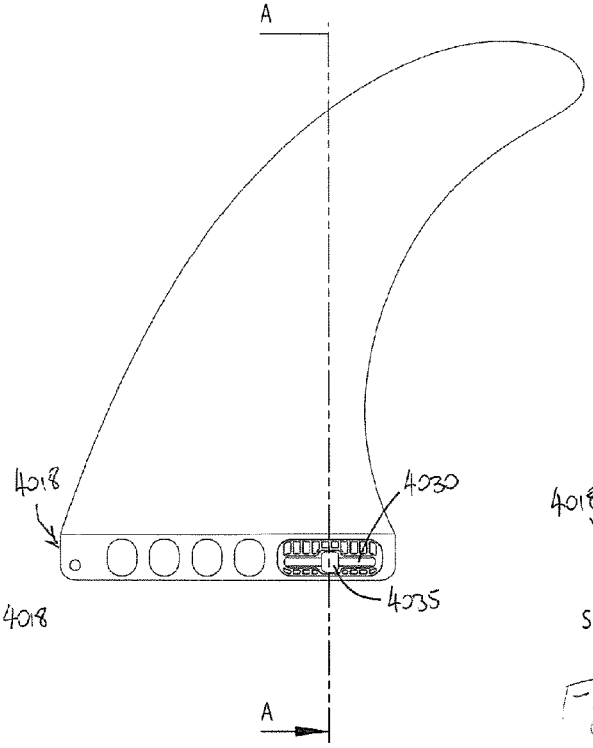
Figure 14D:
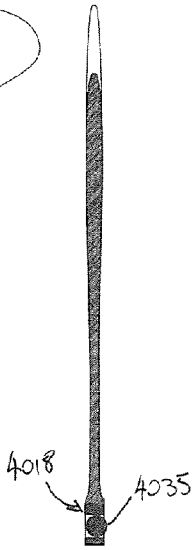
Figure 14E:
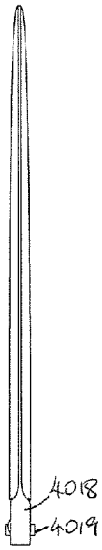

As better seen in FIGS. 13A to 13C and in section views 14D and 15D, the wheel-like protruding member has a diameter preferably matching the width of the cartridge body 4002 and the biasing rod 4030 is supported in the cartridge with its axis off-centre, so that part of the protruding member 4035 extends beyond the side of the cartridge and, when installed, beyond the side of the fin base portion.

The construction of the resilient rod 4030 and of the wheel-like protruding member 4035 may be similar to those described above, for example with reference to FIGS. 1A and 1B.

The cartridge body 4002 may be formed with perforations 4012 to reduce weight, and may be formed of any suitable material, and by any suitable means, for example molded from plastics material such as Glass-filled Nylon, ABS, Acetal.

FIGS. 13 A to 13D show installation of the cartridge into the base portion 4018 of a fin 4050, and FIGS. 14A to 14E illustrate a fin 4050 with the securing mechanism cartridge 4000 installed in the fin base.

The rear of the fin base portion 4018 includes a large elongated cavity 4014 for receiving the cartridge, which may be secured in place by a friction/interference fit or alternatively glued or welded in place. The smaller cavities 4016 in the fin base portion 4018 serve to reduce weight.

The width of the cartridge is preferably no wider than that of the fin base into which it is installed, except for the upper profile of the cartridge which preferably has a width slightly greater than the corresponding with of the slot so that when these parts meet there is an interference fit. This creates a tighter fit between fin base and slot, which reduces fin base wobble (which is a desired attribute in smoothly transferring the energy of the surfer to the fin).

At the front of the fin base portion is a transverse pin 4019 projecting at both sides of the fin base, for engaging with tracks in the side surfaces of the fin plug to secure the front of the fin in the fin plug.

Figure 15A:
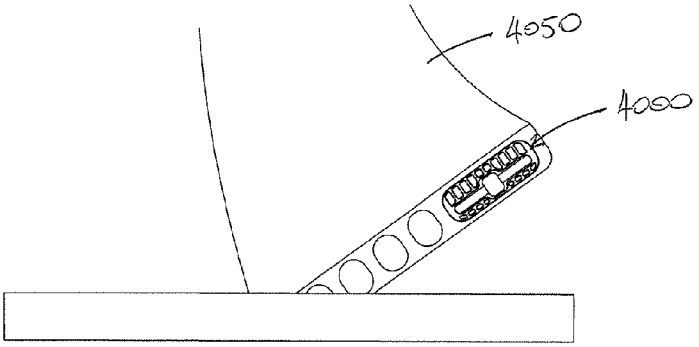
FIGS. 15A to 15C show the fin being installed in a water craft.
Figure 15B:
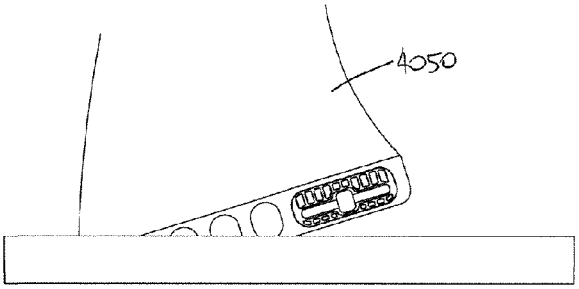
Figure 15C:
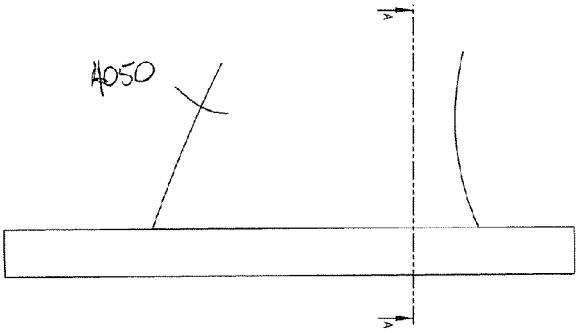

FIGS. 15A to 15C show a sequence for installing the fin of FIGS. 13A to 14E in the fin plug of a surf craft.

In FIG. 15A, the fin is inserted in the fin plug at an angle, so that the projecting portions of the transverse pin 4019 are fed into the longitudinal tracks 4021 in both sides of the fin plug cavity.

Figure 15D:
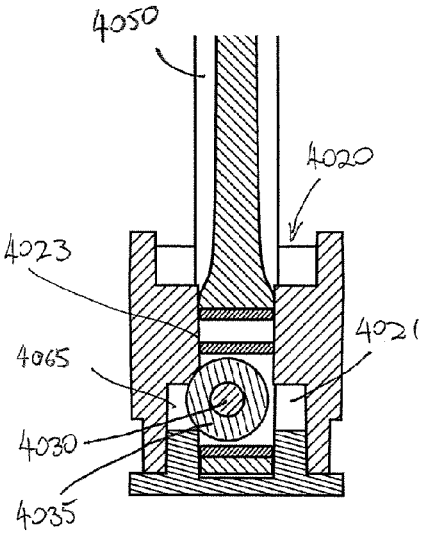

The fin is then moved forward, moving the pin 4019 along the tracks 4021, until the front of the fin base portion reaches the desired location within the fin plug cavity. Then the rear of the fin is pivoted down (FIG. 15B) to engage the securing mechanism. As the wheel-like protruding member 4035 of the mechanism contacts the side surface 4023 of the fin plug cavity 4020, the rod 4030 resiliently flexes to allow the member 4035 to ride inwards and to snap fit into an undercut lateral recess 4065 formed in the side surface of the fin plug cavity (FIG. 15D).

The resilient rod 4030 will remain slightly bent when the fin is fully inserted, the spring force thus provided by the rod 4030 helping to retain the member 4035 firmly in the undercut recess to keep the fin secured to the fin plug.

In addition to producing a lateral force between the fin base and the fin plug cavity, the engagement of member 4035 with the undercut recess may also provide a downwards force vector on the fin, forcing the bottom surface of the fin base against the base of the fin plug cavity and retaining the slightly tapered cartridge in interference fit engagement with the sides of the fin plug cavity. This aids stability of the fin engagement in the water craft.

To remove the fin from the water craft, for example for replacement or transport, the rear of the fin is pivoted upwards to again flex the rod 4030 and 'snap' the securing mechanism out of the fin plug cavity, in essentially the opposite sequence to the insertion sequence of FIGS. 15A to 15C. There is a low risk of unintentional disengagement during use of the water craft as it is not an angle from which the fin will normally be knocked in use.

This cartridge embodiment has the advantage that the cartridge may be adapted for installation in a variety of different fin configurations, or in other devices such as storage hooks, with less tooling expense.

Figure 16A:
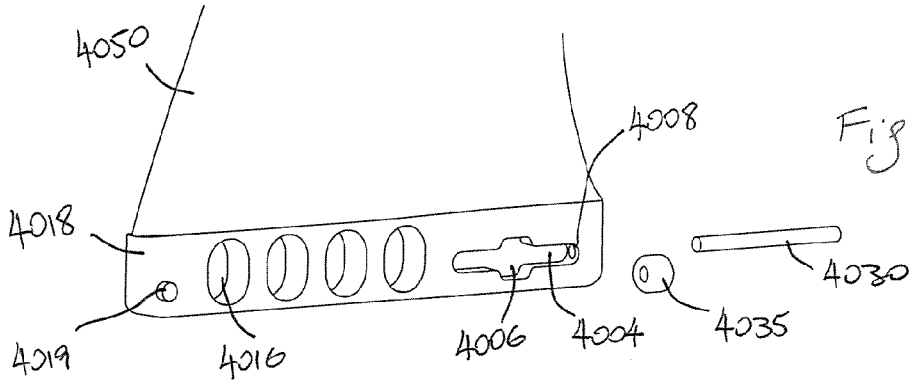
FIGS. 16A to 16C is a series of views showing construction and assembly of a fin in which a resilient biasing rod and protruding member are installed directly.
Figure 16B:
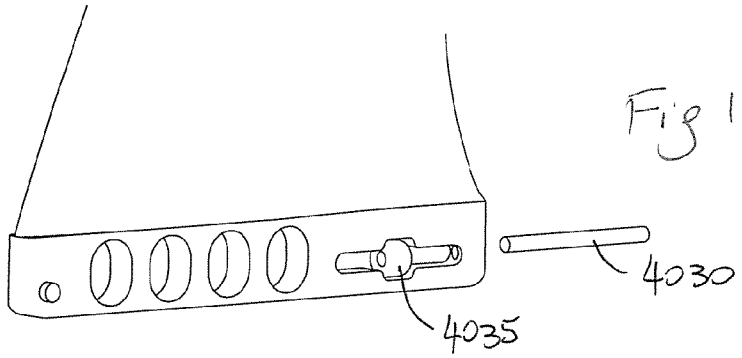
Figure 16C:
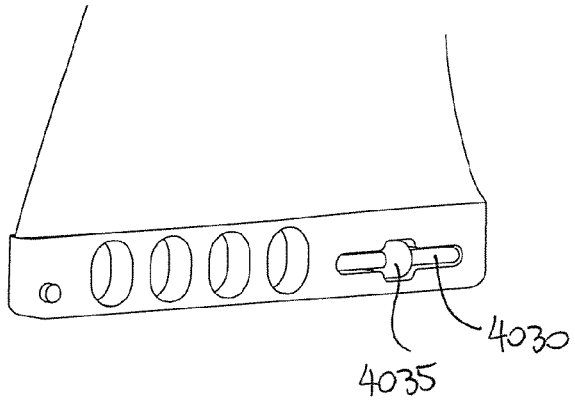

FIGS. 16A to 16C show an alternative example embodiment, in which the resilient rod 4030 and protruding member 4035 of the securing mechanism are installed directly in the fin base portion 4018, rather than in a cartridge installed in the fin base. Otherwise, the construction and operation of the embodiment of FIGS. 16A to 16C are similar to that of FIGS. 13A to 15D.

The embodiments of FIGS. 12A to 16C use a transverse pin 4019 engaging with the longitudinal tracks 4021 to secure the front of the fin base in the fin plug cavity. It will be appreciated that the disclosure extends to other mechanisms to perform this function, including for example an arrangement similar to the recess 85 and protrusion 80 of FIGS. 1A to 11D, or a recess formed between a ledge and a base surface of the fin plug cavity, adapted to receive the fin section, for example as shown in FIGS. 12A to 12H of WO 2014/008529.

Although the fin plug of the first aspect of this invention is primarily intended to be used with water craft fins (e.g. surfboard fins) of the second aspect of this invention, so as to enable such fins to be easily and conveniently attached to, or detached from the fin plug (without the use of a tool), it is not limited to such use. For instance, other water craft attachment devices can be selectively attached to, or detached from, the relevant fin plug in substantially the same way as the abovementioned fins are attached or detached.

An example of such other water craft attachment devices is a hanger/hook device, not shown, for example generally as described and shown in FIGS. 29A to 29H of WO 2014/008529. As will readily be appreciated, this hook device is adapted to be connected to a surfboard (or other water craft) so that the surfboard (or other water craft) can be suspended from a horizontal supporting rod (or similar structure).

The base portion of the hook device may be configured to receive a securing mechanism cartridge for example as shown in FIGS. 12A to 12C, or alternatively to receive directly a biasing rod and protruding member in similar arrangement to the fin base shown in FIGS. 16A to 16C.

Notably, it will be appreciated that although many different materials can be used for the fin plug 10, it can be formed of ABS (Acrylonitrile Butadiene Styrene, or any other plastics) or Zytel. The rod 30 or 4030 is typically formed of any elastic material such as high grade stainless steel or titanium, which is also a robust material in watercraft as the material does not generally degrade or rust. The same robust material may also be used for the extending portion 35 or 4035. It will further be appreciated that the device 10 can be injection molded.

The cartridge body may also be formed of many different materials. Typically, the cartridge body will be injection molded plastics, with (Glass-filled Nylon, ABS, Acetal being examples of preferred materials.

It will also be appreciated that the described hook device can be formed from many different materials. Typically, this device will be formed from appropriate plastic materials which are relatively inexpensive and sufficiently strong for suspending a surfboard (or other water craft) from a supporting rod.

In this specification, terms denoting direction, such as vertical, up, down, left, right etc. or rotation, should be taken to refer to the directions or rotations relative to the corresponding drawing rather than to absolute directions or rotations unless the context require otherwise.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

We claim:

1. A fin adapted for installation in a fin plug of a water craft, the fin plug including a fin plug cavity adapted to receive a base portion of the water craft fin, the fin includes:

a resilient rod extending substantially parallel to a side surface of the base portion of the fin; and a protruding member located about the resilient rod such that the protruding member protrudes into the fin plug cavity when installed in the fin plug;

wherein the protruding member is adapted to engage with the fin plug upon insertion of the fin base portion such that insertion causes the resilient rod to bend resiliently and the protruding member to rotate about a longitudinal axis of the resilient rod, to receive and removably retain the fin base portion in the fin plug cavity.

2. A fin according to claim 1, wherein the protruding member is a ring shaped member.

3. A fin according to claim 2, wherein wherein the ring-shaped member has a circumferential outer surface extending between two side surfaces, the circumferential outer surface having a convex profile between the side surfaces.

4. A fin according to claim 2, wherein the ring shaped member is adapted to rotate about the resilient rod.

5. A fin according to claim 2, wherein the resilient rod is mounted so that a longitudinal axis of the resilient rod is offset to a midpoint of the fin base portion such that an outer circumference of the ring-shaped member extends beyond the side surface of the fin base portion.

6. A fin according to claim 2, wherein an outside diameter of the ring-shaped member is substantially equal to a width of the fin base portion.

7. A fin according to claim 1, wherein a side surface of the fin plug cavity includes a lateral recess, the lateral recess being adapted to cooperate with the protruding member so as to cause a force, that is at least one of inwardly and laterally into said fin plug cavity, to be applied to the fin base portion under the influence of the resilient rod;

whereby a removal of the fin from the fin plug cavity is inhibited.

8. A fin plug according to claim 7, wherein the lateral recess in the side surface of the fin plug includes an inclined surface section.

9. A fin according to claim 1, wherein a front portion of the base portion has a transverse pin configured to engage with at least one track in the fin plug cavity; and wherein the resilient biasing rod and the protruding member are located in a rear section of the fin base portion.

10. A fin according to claim 9, wherein the at least one track is longitudinally extending in a side wall of the fin plug cavity.

11. A fin according to claim 9, wherein the at least one track in the fin plug includes a lateral recess in a side wall of the fin plug cavity, and wherein the lateral recess is adapted to receive the protruding member.

12. A fin according to claim 1, wherein a front section of the fin base portion has a recess, the front section recess is adapted to receive a protrusion in the fin plug cavity, to form cooperating structures to retain the front section of the fin base portion in the fin plug cavity; and wherein the resilient biasing rod and the protruding member are located in a rear section of the fin base portion.

13. A fin according to claim 1, wherein a front section of the fin base portion is adapted to engage with a ledge extending from a front end of the fin plug cavity; and wherein the resilient biasing rod and the protruding member are located in a rear section of the fin base portion to engage with a rear of the fin plug cavity.

14. A fin according to claim 1, wherein the protruding member is located substantially at a mid-point of the resilient rod.

15. A fin according to claim 1, wherein the resilient rod is supported substantially at the ends of the resilient rod within the fin, thereby causing the resilient rod to bend substantially at the middle of the resilient rod.

16. A fin according to claim 1, wherein the resilient rod is an elongate member.

17. A fin according to claim 1, wherein a material for the resilient rod is at least one of a titanium, a steel, a stainless steel, a marine grade steel, a fiberglass, a carbon fibre, a plastic and a reinforced engineering plastic.

18. A fin according to claim 1, wherein the resilient rod and the protruding member are included in a cartridge incorporated in the fin base portion.

19. A fin according to claim 18, wherein an outside diameter of the protruding member is substantially equal to a width of the cartridge.

20. A fin according to claim 18, wherein the resilient rod is mounted such that a longitudinal axis of the resilient rod is offset to a midpoint of the cartridge such that an outer circumference of the protruding member extends beyond a side surface of the cartridge.

21. A fin according to claim 1, wherein at least two of the protruding member, a transverse pin, a front section recess of the fin base portion, a ledge portion in the fin plug cavity, a lateral recess in the fin plug cavity and a longitudinal track of the fin plug cavity snap-lock together.

22. A fin according to claim 1, wherein the co-operation of the protruding member, the bending of the resilient rod and a lateral recess of the fin plug cause the fin and the fin plug to snap-lock together.

23. A fin according to claim 1, further including a snap-lock action limited by an impact of a fin base portion surface and a fin plug surface;

wherein the fin base portion impact surface includes at least one of a bottom of the fin base portion, a front of the fin base portion and a rear of the fin base portion; and wherein the fin plug impact surface includes at least one of a rear wall of the fin plug cavity, a front wall of the fin plug cavity and a bottom of the fin plug cavity.

24. A fin according to claim 1, wherein the water craft is at least one of a longboard, a stand-up paddle board, a larger surf craft and a shortboard.

25. A cartridge adapted for installation in a fin plug of a water craft, the fin plug including a fin plug cavity adapted to receive the cartridge, the cartridge includes:

a cartridge body supporting a protruding member and a resilient rod;

the resilient rod extending substantially parallel to a side surface of the cartridge;

the protruding member located about the resilient rod such that the protruding member protrudes into the fin plug cavity when installed in the fin plug;

wherein the protruding member is adapted to engage with the fin plug upon insertion of the cartridge such that insertion causes the resilient rod to bend resiliently and the protruding member to rotate about the longitudinal axis of the resilient rod to receive and removably retain the cartridge in the fin plug cavity; and wherein a side surface of the fin plug cavity includes a lateral recess, the lateral recess being adapted to cooperate with the protruding member of the cartridge so as to cause a force, that is at least one of inwardly and laterally into said fin plug cavity, to be applied to the cartridge under the influence of the resilient rod;

whereby a removal of the cartridge from the fin plug cavity is inhibited.

* * * * *